US006677513B1

(12) United States Patent
Rutter

(10) Patent No.: US 6,677,513 B1
(45) Date of Patent: Jan. 13, 2004

(54) SYSTEM AND METHOD FOR GENERATING AND ATTENUATING DIGITAL TONES

(75) Inventor: Roger Sherman Rutter, Owego, NY (US)

(73) Assignee: International Business Machines Corporation, Armonk, NY (US)

( * ) Notice: Subject to any disclaimer, the term of this patent is extended or adjusted under 35 U.S.C. 154(b) by 0 days.

(21) Appl. No.: 09/087,534

(22) Filed: May 29, 1998

(51) Int. Cl.[7] ..... G10H 1/06; G10H 7/00
(52) U.S. Cl. ..... 84/622
(58) Field of Search ..... 84/622, 623, 659

(56) References Cited

U.S. PATENT DOCUMENTS

| | | | | | |
|---|---|---|---|---|---|
| 4,015,220 | A | | 3/1977 | Kaufman | 331/179 |
| 4,056,692 | A | | 11/1977 | Place | 179/84 VF |
| 4,061,886 | A | | 12/1977 | Callahan, Jr. et al. | 179/84 VF |
| 4,150,599 | A | | 4/1979 | Southard | 84/1.03 |
| 4,392,406 | A | | 7/1983 | Fritz | 84/1.26 |
| 4,399,535 | A | | 8/1983 | Southard | 370/110.2 |
| 4,483,229 | A | | 11/1984 | Tsukamoto et al. | 84/1.01 |
| 4,561,337 | A | | 12/1985 | Wachi | 84/1.01 |
| 4,577,287 | A | * | 3/1986 | Chrin | 708/276 |
| 4,599,583 | A | | 7/1986 | Shimozono et al. | 332/9 R |
| 4,761,751 | A | * | 8/1988 | Canniff | 708/276 |
| 4,815,352 | A | | 3/1989 | Tsukamoto et al. | 84/1.01 |
| 4,839,842 | A | | 6/1989 | Pyi et al. | 364/721 |
| 4,888,719 | A | * | 12/1989 | Yassa | 708/276 |
| 4,998,281 | A | | 3/1991 | Sakata | 381/63 |
| 5,146,418 | A | | 9/1992 | Lind | 364/729 |
| 5,243,124 | A | * | 9/1993 | Kondratiuk et al. | 84/624 |
| 5,325,422 | A | | 6/1994 | Ladd | 379/67 |
| 5,338,891 | A | | 8/1994 | Masubichi et al. | 84/600 |
| 5,418,734 | A | | 5/1995 | Kawamura et al. | 364/718 |
| 5,418,782 | A | | 5/1995 | Wasilewski | 370/73 |
| 5,457,701 | A | | 10/1995 | Wasilewski et al. | 371/37.1 |
| 5,524,087 | A | | 6/1996 | Kawamura et al. | 364/721 |
| 5,689,080 | A | * | 11/1997 | Gulick | 84/604 |

* cited by examiner

*Primary Examiner*—Jeffrey Donels
(74) *Attorney, Agent, or Firm*—Shelley M Beckstrand

(57) ABSTRACT

An audible tone is generated and attenuated over a wide frequency range, such as throughout the human audible range, the tone selectively being of short duration. During a tone period a digital representation of the sine of a requested tone frequency and amplitude is generated. During an attenuation period a digital representation of a moderately disturbed but continuous sine of decreasing amplitude is generated. During a decay period a digital representation of a continuous function which decays to zero from the zero approach point of the sine half wave is generated. During the attenuation period, at zero crossings, the amplitude value is multiplied by a fractional constant; within zero passing zones, the amplitude between subsequent samples is incremented by temporally reduced values to further attenuate the tone and accumulate a bank of accumulated reductions in increments; and while approaching zero crossings, a sine wave of maximum amplitude equal to the amplitude at the beginning of the prior quadrant minus the bank of accumulated reductions in increments during said prior quadrant is generated; and during a decay period, a digital representation of a continuous function which decays to zero amplitude is generated.

17 Claims, 13 Drawing Sheets

252

| 290 TONE | 292 SAMPLING FREQUENCY "nnotes" 32 K | | 294 44,1 K | | 296 48 K | |
|---|---|---|---|---|---|---|
| C | 42f9 | e49f | 3099 | 76df | 2ca6 | 986a |
| C# | 46f5 | 70df | 337d | 45b6 | 2f4e | 4b3f |
| D | 4b2d | 9d3e | 368d | 1251 | 321c | 68d4 |
| D# | 4fa6 | 049c | 39cb | 7a59 | 3519 | 5868 |
| E | 5462 | 78b9 | 3d3b | 4348 | 3841 | a5d1 |
| F | 5967 | 0579 | 40df | 5cc9 | 3b9a | 03a6 |
| F# | 5eb7 | f459 | 44ba | e33a | 3f25 | 4d91 |
| G | 6459 | d01a | 48d1 | 2253 | 42e6 | 8abc |
| G# | 6a51 | 689e | 4d25 | 97f5 | 46e0 | f069 |
| A | 70a3 | d70a | 51bb | f72d | 4b17 | e4b1 |
| A# | 7756 | 821e | 5698 | 2b55 | 4f8f | 016a |
| B | 7e6f | 22d3 | 5bbe | 5b72 | 544a | 1737 |

0 31 32 63 64 95

242 290 291

| INDEX | OCT | NOTE | NOTE |
|---|---|---|---|
| 127 | 10 | 7 | G |
| 126 | 10 | 6 | F# |
| 125 | 10 | 5 | F |
| . . . | . . . | . . . | . . . |
| 2 | 0 | 2 | D |
| 1 | 0 | 1 | C# |
| 0 | 0 | 0 | C |

238

QUADRATICS SINE FIT

| | $AX^2 + BX + C$ | | |
|---|---|---|---|
| | A | B | C |
| 0 | ff51 | 4750 | 0000 |
| 1 | fdfa | 45f1 | 2351 |
| 2 | fcb6 | 41e1 | 4546 |
| 3 | fb94 | 3b49 | 6492 |
| 4 | fa9c | 326a | 8000 |
| 5 | f9da | 279b | 9683 |
| 6 | f954 | 1b46 | a73d |
| 7 | f90f | 0de5 | b18b |
| 8 | f90f | fffc | b505 |
| 9 | f954 | f212 | b18b |
| 10 | f9da | e4b2 | a73d |
| 11 | fa9c | d85e | 9683 |
| 12 | fb94 | cd90 | 8000 |
| 13 | fcb6 | c4b2 | 6492 |
| 14 | fdfa | be1c | 4546 |
| 15 | ff51 | ba0e | 2351 |

SYSTEM AND METHOD FOR GENERATING AND ATTENUATING DIGITAL TONES

FIELD OF THE INVENTION

This invention relates to the generation and attenuation of digital signals for input to a digital to analog converter to produce an audible tone. More specifically, it relates to use of a digital signal processor (DSP) to generate pulse coded modulation (PCM) values representing a set of predefined tones in a memory space and processing cycles efficient manner.

BACKGROUND OF THE INVENTION

A tone is a pure sine wave. Pulse coded modulation (PCM) data is a digital representation of an analog signal, such as a sine wave, at fixed time intervals.

Digital signal processors (DSPs) may be used to generate tones. This they do by generating electrical signals which are input to a digital to analog converter (DAC) to produce an analog electrical signal that will cause one of a set of tones to be produced with an appropriate audio amplifier and speaker. These processors usually have limited function, providing only fixed point operations and multiply, but not divide.

If a tone stops at a non-zero value, or the tone goes to zero at a high rate, or the sine is distorted by being attenuated at an increasing rate, the resulting sound will contain "clicks", "pops", or "thuds". Since tone duration may be short (say, 0.1 seconds) and there may only be between 16,000 and 48,000 samples per second, the whole tone may contain only 1600 samples. Attenuation should be complete in about ten percent of these samples, and the solution should use little code and little memory.

For short tones the attenuation duration must also be short. As the duration of a sine or of a few sine oscillations approach the period of the attenuation duration, noiseless attenuation becomes difficult. Some distortion must be expected. For instance, a sine wave cannot be changed during a half wave and still be a pure sine wave.

Synchronization of digital video and digital audio data streams is a requirement of the art. Because digital video data is typically compressed on picture frames, and audio is typically compressed on frames of a fixed number of samples, synchronization following a discontinuity in the audio program has heretofore required that a certain frame boundary be identified as a sync point. There is, therefore, a need in the art for an improved method which avoids the need to re-synchronize video and audio data by allowing decode of the audio program to continue. In accordance with the present invention, this is accomplished by substituting a digital tone value for the audio program output value. This digital tone generation is an additional processing load on the DSP and it is desirable to minimize this load.

It is, therefore, an object of the invention to generate short tones with rapid attenuation while avoiding objectionable noise.

It is a further object of the invention to operate a digital signal processor in a memory space and processing cycles efficient manner to generate and attenuate tones.

It is a further object of the invention to attenuate a tone without creating, or at least minimizing, additional sounds or artifacts at the end of the tone, such as "clicks", "pops", or "thuds".

It is a further object of the invention to produce a large number of tones and tone durations across and beyond the entire audio range.

It is a further object of the invention to produce a sine wave of highly accurate frequency.

It is a further objective of the invention to replace a segment of a playing audio stream with a tone of the same sampling frequency as the audio stream in order to maintain synchronization between audio and video data.

SUMMARY OF THE INVENTION

In accordance with the method of the invention, an audible tone is generated and attenuated over a wide frequency range, such as throughout and beyond the human audible range, the tone selectively being of short duration, including the steps of generating during a tone period a digital representation of the sine of a requested tone frequency and amplitude; generating during an attenuation period a digital representation of a moderately disturbed but continuous sine of decreasing amplitude; and generating during a decay period a digital representation of a continuous function which decays to zero from the zero approach point of the sine half wave.

In accordance with a further aspect of the method of the invention, the method includes during the attenuation period the steps of multiplying the amplitude value by a fractional constant at zero crossings; incrementing within zero passing zones the amplitude between subsequent samples by reduced values to further attenuate the tone and accumulate a "bank" of accumulated reductions in increments; and while approaching zero crossings the steps of generating a pure sine wave of maximum amplitude equal to the amplitude at the end of the prior quadrant; and during a decay period, the step of generating a digital representation, of a continuous function which decays exponentially to zero amplitude.

In accordance with the system of the invention, a digital signal processor is provided for generating and attenuating an audible tone over a wide frequency range, such as throughout and beyond the human audible range, the tone selectively being of short duration. Responsive to a request to generate a tone of a specified tone and sampling index, tone request logic determines an increment angle. Responsive to said increment angle and a periodic sampling interrupt, sample generation logic generates during a tone period a digital representation of the sine of a requested tone frequency and amplitude; generates during an attenuation period a digital representation of a moderately disturbed but continuous sine of decreasing amplitude; and generates during a decay period a digital representation of a continuous function which decays to zero from the zero approach point of the sine half wave.

DESCRIPTION OF THE PREFERRED EMBODIMENTS

Figure 1:
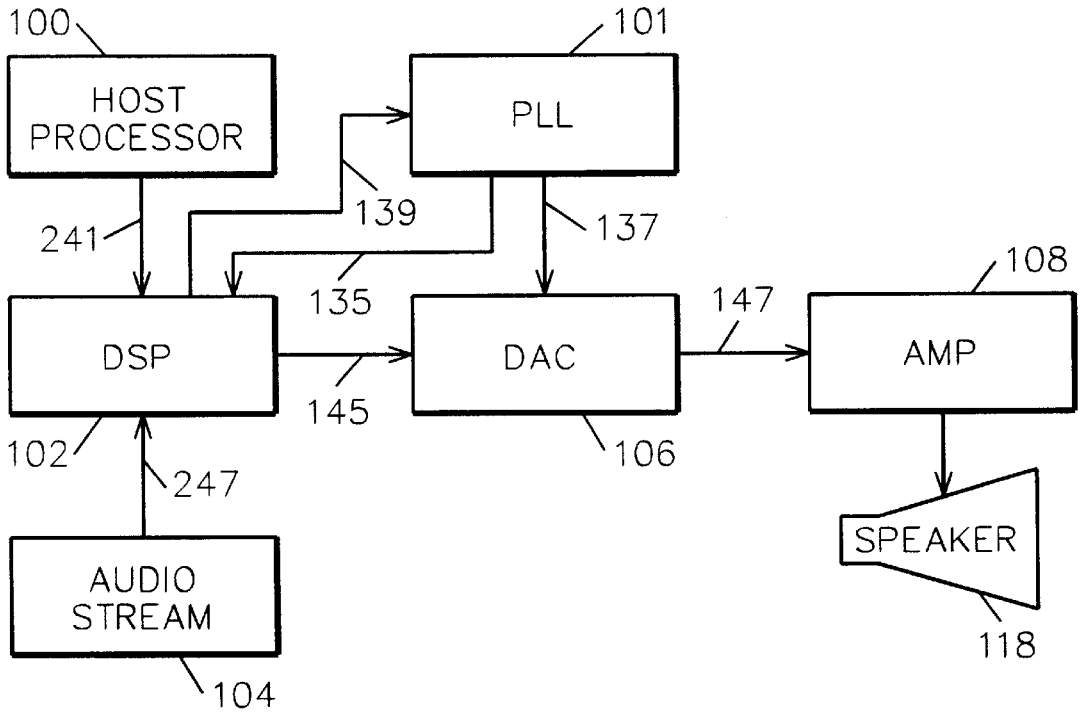
FIG. 1 is a high level system diagram of tone generation and attenuation system in accordance with the invention in an representative system environment.

The invention will be described with respect to three embodiments, including a pseudo-code representation of the tone attenuation and decay methods (Table 1), a C code implementation (Table 2) and a DSP code implementation (Table 3). Generally, the preferred embodiment is that of Table 3. However, for purposes of clarification of various concepts and to illustrate equivalent structures and methods, the embodiments of Tables 1 and 2 are presented.

| Glossary and Abbreviations | |
|---|---|
| m | AMPLITUDE CONTROL, aka AMPLITUDE MULTIPLIER. See ATTENUATION INDEX |
| $\alpha(i)$ | ANGLE at this sample i |
| $\Delta T$ | ANGLE INCREMENT |
| 142 | ATTENUATION PERIOD |
| 248 | ATTENUATION INDEX, used to calculate initial value for AMPLITUDE CONTROL m |
| $\beta$ | BANK |
| $2\pi$ | CYCLE (sine wave from 0 to $2\pi$) |
| 190 | DECAY |
| | DECAY DISTANCE, an approximation of y(i) as a condition to enter decay |
| 144 | DECAY PERIOD |
| $\Delta T$ | DELTA T: angle increment (called "note" in DSP implementation, and "angleinc" in C code implementation. These implementations are in different units. C code is in natural, or mathematical units, and the DSP code is done in computationally efficient units.) |
| $\Delta t$ | DELTA t: time interval |
| DAC | DIGITAL TO ANALOG CONVERTER |
| f | FREQUENCY |
| y(i) | OUTPUT value of ith sample (digital amplitude value presented to DAC by DSP) |
| PCM | PULSE CODED MODULATION |
| $\pi$ | Pi = 3.14159 . . . |
| q | QUADRANT |
| a,b,c | QUADRATIC COEFFICIENTS |
| r | SAMPLING RATE (see, SAMPLING INDEX) |

-continued

| Glossary and Abbreviations | |
|---|---|
| r | SAMPLING FREQUENCY (see, SAMPLING INDEX) |
| r | SAMPLING INDEX |
| sin | SINE |
| | STEP CONTROL ("dampadd") |
| | STEP LIMIT ("dampstep" in C code, "atndcay" in DSP code), a step size related to sampling frequency |
| 194 | STOP |
| 242 | TONE INDEX |
| 140 | TONE PERIOD |
| 150 &c | ZERO CROSSING (occurs at 0, $\pi$, and $2\pi$) |
| 184 | ZERO APPROACH POINT |
| 152 | ZERO PASSING ZONE |

In accordance with the preferred embodiments of the invention, a memory space and processing cycles efficient method and means is provided for computing pulse coded modulation (PCM) values that represent a set of predefined tones. Specifically, digital to analog converter (DAC) inputs are created by a digital signal processor (DSP) that will produce in the DAC an analog electrical signal output to cause one of a set of tones to be produced when applied to an appropriate audio amplifier and speaker.

Attenuation is performed by: (1) reducing the maximum amplitude of the output; (2) reducing the size of the step between two adjacent outputs; and (3) exponentially decaying from the sine to zero. These attenuation actions are applied at certain points in the sine. The amplitude is adjusted when the angle changes quadrant. The step size between two outputs is reduced in a portion of the first and third quadrants, when the sine is moving away from zero. A decision to continue the sine or switch to exponential decay is made in the second and fourth quadrants when the sine is moving toward zero, where the switch may also occur. A continuous function is maintained and, except when the sine value is crossing zero, a continuous first derivative of the function is also maintained. An abrupt but limited change in amplitude occurring when the sine crosses zero does not create objectionable noise.

Referring to FIG. 1, a tone generation and attenuation system in accordance with the invention is implemented within digital signal processor (DSP) 102. DSP 102 receives inputs on line 241 from host processor 100 and on line 135 from phase locked loop (PLL) logic 101, and selectively on line 247 from audio stream 104. The output of DSP 102 is fed to digital to analog converter (DAC) 106, the output of which is fed to amplifier 108 and thence to speaker 118. PLL logic 101 receives sample index signal 139 from DSP 102 (the sample index value used to generate sample index signal 139 was provided to DSP 102 by host processor 100 or audio stream 104), and drives sample clock signal 135 to DSP 102 and an over sampled clock signal 137 to DAC 106. PLL logic 101 locks at the frequency defined by sample clock signal 139, and responds with a clock signal on line 135, with each clock signal pulse 135 representing an interrupt request that DSP generate a sample output on line 145 to DAC 106.

Figures 2, 4:
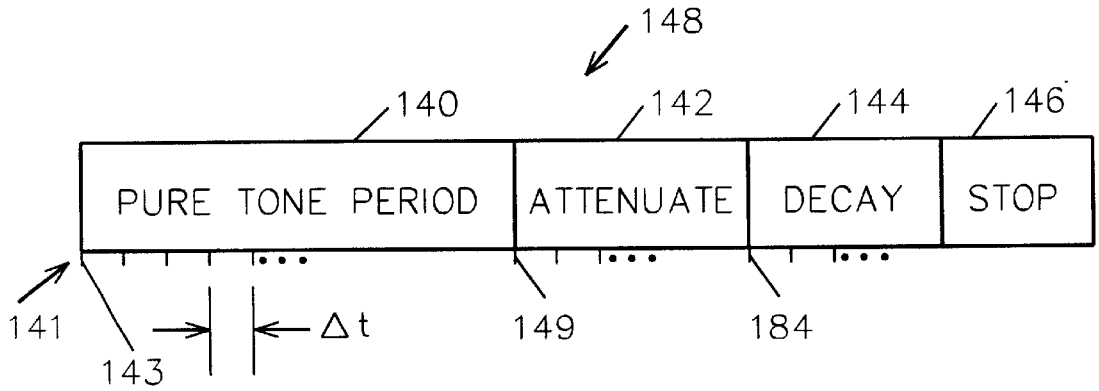
FIG. 2 is a diagram illustrating a tone period, including pure tone period, attenuation period, decay period and stop period as a function of time.
FIG. 4 illustrates a table of tone delta T values for each of plurality of sampling frequencies.

Referring to FIG. 2, DSP 102 generates digital representations of a selected tone at sampling points 141 during tone period 148, which includes pure tone period 140 (beginning with sample 143), attenuate period 142 (beginning with sample 149), decay period 144 (beginning with sample 184) and stop 146. Sampling points 141 are generated at a time interval $\Delta t$.

Tone Generation

In the preferred embodiments, DSP 102 generates one of 128 tones, sine waves of 128 different frequencies selected from among 31 different durations. The tones are those of an equal tempered chromatic scale, but could be others with different constants.

Tones are generated using a digital signal processor (DSP) 102. These processors 102 usually have limited function, providing only fixed point and multiply operations, but not divide operations. The method and system of the invention are particularly useful where few cycles are available in DSP 102 for tone generation.

Figure 3:
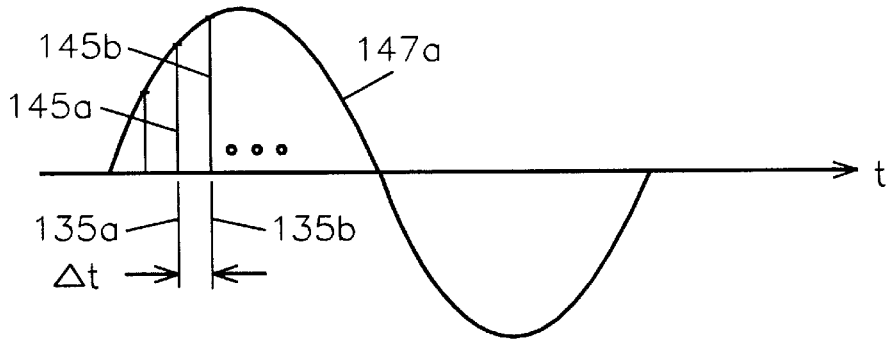
FIG. 3 is a representation of an analog sine wave output from the DAC, generated from digital inputs from DSP, of FIG. 1.

Referring to FIG. 3, PCM data is a digital representation of an analog signal created by sampling the digital value of the signal at fixed time intervals Δt, or by generating digital values representative of the analog signal. In this embodiment, analog sine wave output 147*a* provided from DAC 106 to amplifier 108 on line 147 is generated by smoothing digital values 145*a*, 145*b* received on line 145 from DSP 102. DAC 106 uses over sampled clock signal 137 to smooth clocked digital signal values received on line 145 from DSP 102. Typically, responsive to over sampled clock signal 137 and by way of Fourier analysis, DAC 106 does a curve fit to digital values 145*a*, 145*b* sequentially received at rate Δt, such as times 135*a*, 135*b*, respectively, on line 145 to thereby project future points which accumulate in time to define the analog tone signal curve 147*a*, which signal 147*a* is fed on line 147 to amplifier 108 and thence to speaker 118.

Representative DACs, useful in connection with the DSP of the present invention is the 16 Bit Audio DAC by Crystal (Cirrus Logic), P/N CS4328, and equivalents, such as P/N CS4331 and CS4327, which are 18 and 20 bit Audio DACs, respectively.

Because a tone is a pure sine wave 147*a*, sampling a tone at a fixed time interval Δt from the last sample is the same as calculating the sine of an angle α(i) at a fixed angle increment ΔT from the angle α(i−1) of the last sample. In accordance with the invention, a value representation is provided for making tone generation simple (that is, efficient in processing cycles and memory space) when tone generation is decomposed into two processes: (1) a process for generating a sequence of angles with the appropriate increment ΔT between each adjacent pair of angles; and (2) a process for computing the sine of the angle. Delta T is accumulated to form an angle of which the sine will be calculated to generate a digital tone sample. "Angle" refers to the accumulated delta T's from the beginning of the tone to this, the ith, sample, which is equal to (i)*ΔT.

A user, such as host processor 100, specifies a tone by providing to DSP 102 a tone index, which is an integer in a range, such as the range 0 to 127 selected for the embodiments described herein. In the equal tempered chromatic scale, the frequency f(i) of note N(i) is $$f(i)=2^{**}(1/12)*f(i-1), \tag{1}$$

where f(i−1)is the frequency of note N(i−1). Thus, the frequency f(i) of note N(i) is also 2*f(i−12) of note N(i−12) and 1/2*f(i+12) of note N(i+12).

Referring to FIG. 4, a table of tones for each of plurality of sampling frequencies is illustrated. In accordance with the preferred embodiment (Table 3) of the invention, user processor 100 or audio stream 104 may specify a sampling rate 240. In the case of audio stream 104, the sampling rate is determined by the sampling rate of the audio stream. Alternatively, sampling rate 240 may be determined by prior or current material being played or, as in the embodiment of Table 2, a fixed sampling rate may be hard coded. The increment ΔT' between angles may be computed as $$\Delta T=2*\Pi*f/r \tag{2}$$

which is an increment in radians, and where f is the frequency, r is the sampling rate or frequency, and Π=3.14159 . . . Also, $$\Delta T=65{,}536*\Delta T/2\Pi \tag{3}$$

such that one cycle is represented by 65,536 units. In the preferred embodiments described herein, fractional units are carried in 16 bits for high frequency precision.

For a limited number of sampling rates, table 252 provides for each sampling rate 292, 294, 296 a list of the angle increments ΔT for the highest frequency of each of the twelve possible note tones 290. The angle increments ΔT for all lower frequency notes are computed by shifting the highest note increment from table 252 right once for each twelve units (octave) by which the tone index of the highest note and the tone index of the selected note differ.

In the preferred embodiment (Table 3), the six sampling rates accommodated are 16 KHz, 22.05 KHz, 24 KHz, 32 KHz, 44.1 KHz, and 48 KHz (where KHz means kilohertz.) These require three tables 292, 294 and 296. The angle increments for the lowest three sampling rates (16 KHz, 22.05 KHz and 24 KHz) are computed by doubling the increment for the higher rate (32 KHz, 44.1 KHz, and 48 KHz, respectively).

ΔT values in table 252 are computed with reference to the American Standard pitch of the equal tempered chromatic scale at A6=440 cycles per second (A6 represents tone A in the sixth octave of the scale).

Referring further to FIG. 4, by way of illustration of sampling frequency table 252, at a sampling frequency of 44.1 KHz, the angle increment ΔT for note 290 tone A in the eleventh octave is '51bb.f72d' (hex, but with a binary decimal separating the two 16 binary bit half words, such that the first half word, herein '51bb.', is equal to or greater than zero, and the second half word, herein '.f72d', is equal to or less than zero). Therefore, to get to A in the sixth octave, this value is shifted right by five binary bits. (In table 252, the values shown for tones C through G# are in the 10th octave, and A through B are in the 11th octave.) The angle increment for A in the eleventh octave converts to binary:

$$0101\ 0001\ 1011\ 1011\ 1111\ 0111\ 0010\ 1101 \tag{4}$$

By shifting five positions to the right, the angle increment for A in the sixth octave is:

$$0000\ 0010\ 1000\ 1101\ 1101\ 1111\ 1011\ 1001 \tag{5}$$

In hex, this is $$028d.dfb9 \tag{6}$$

where 028d is greater than 1 and dfb9 is less than 1 due to the binary point.

For a full cycle for A of 440 cycles per second, where a cycle means 65,536 units, the computed ΔT times 44100 samples per second gives a value of 28,835,840 units/second, where, as previously stated, 65,536 units are equivalent to 2Π, or a single sine cycle. Thus, $$\Delta T=028d.dfb9\ \text{(hex)}=653.87392\ \text{(decimal)} \tag{7}$$

units per sample.

The total number of units per second is, therefore, 653.87392 times 44,100 equals 28,835,840 (decimal). In accordance with the units implemented in the preferred embodiments of the invention, 65,536 units represent 2Π of angular increment, and the number of cycles per second represented by one second of angular increments as calculated above is 440 (which is the frequency of note A6.)

A 31 bit counter, with a binary point in the middle, counts to a largest value of 65,535.999999 . . . (decimal), which means that the counter wraps 440 times per second for A6. Similarly, a sin wave 2Π wraps 440 times in radians for A6.

As will be described hereafter in connection with FIG. 6, the binary representation of ΔT is accumulated to form a 32 bit value which is α(i), the value in register 271.

Figures 5, 7:
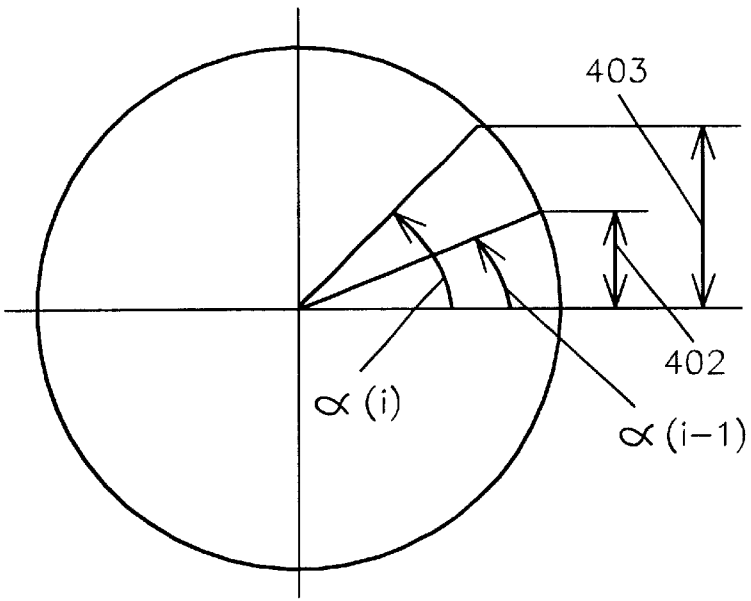
FIG. 5 is a diagrammatic representation of a constant angular increment $\Delta T$ used in generating periodic digital sine values. $\Delta T$ (radians) is a component of angular velocity $\Delta T/\Delta t$ (radians/second), where $\Delta t$ is the time increment between samples.
FIG. 7 illustrates an enumeration of possible computed values of tone indexes to octave and note.

Referring to FIG. 5, the relationship between angular velocity ΔT and the sine value for sample (i) is illustrated. For a given sample (i), the angle α(i) is:

$$\alpha(i)=\alpha(i-1)+\Delta T, \text{ or} \tag{8}$$

$$\text{when } \alpha(0)=0, \text{ then } \alpha(i)=i*\Delta T \tag{9}$$

and the sine value at angle α(i) is represented by value 403 and that for angle α(i−1) by value 402.

Given an angle, the sine of that angle can be computed with reasonable accuracy from a piecewise continuous curve fitted to the true sine values. If a linear fit is used, more points and somewhat less computation are required. A quadratic fit requires fewer points for the same accuracy and one more add and one more multiply. A cubic fit requires still fewer points for the same accuracy, but is more computationally complex. Any of these can be made to operate to a reasonable accuracy specification. In the preferred embodiment (Table 3) of the invention, the quadratic fit is used and performed with some intermediate shifts to preserve accuracy. In the embodiment of Table 2 C code, the sine is directly calculated.

Figure 6:
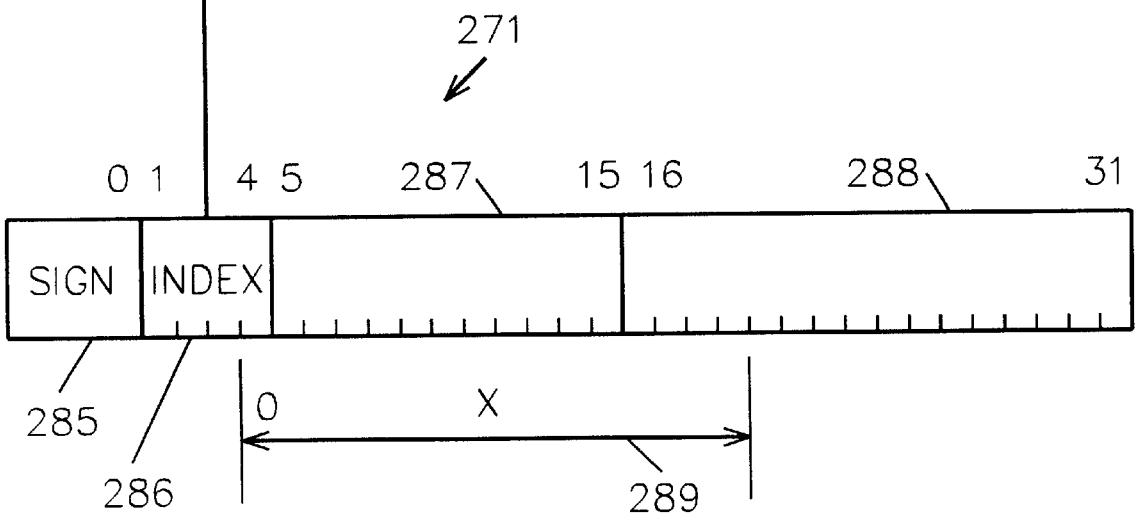
FIG. 6 is a diagrammatic representation of the use of the bits of a digital representation of an angle to determine which quadratic (that is, select the coefficients to use) and the value of the independent variable for evaluating the quadratic to estimate the sine.
Figures 11, 11A:
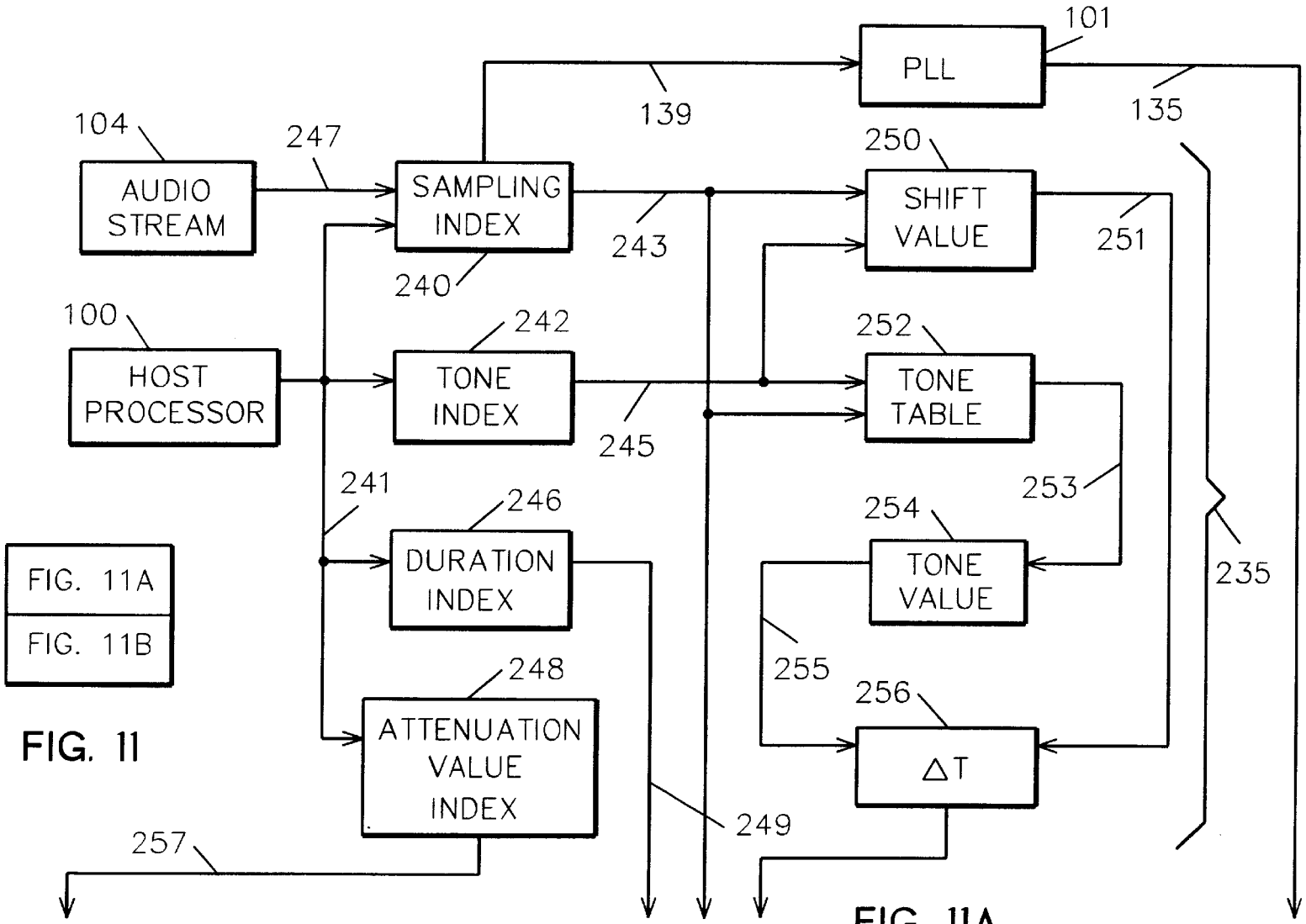
FIG. 11 is a system diagram illustrating the digital the tone request logic and sample generation logic of the digital signal processor (DSP) of FIG. 1 in accordance with a preferred embodiment of the invention.
Figure 11B:
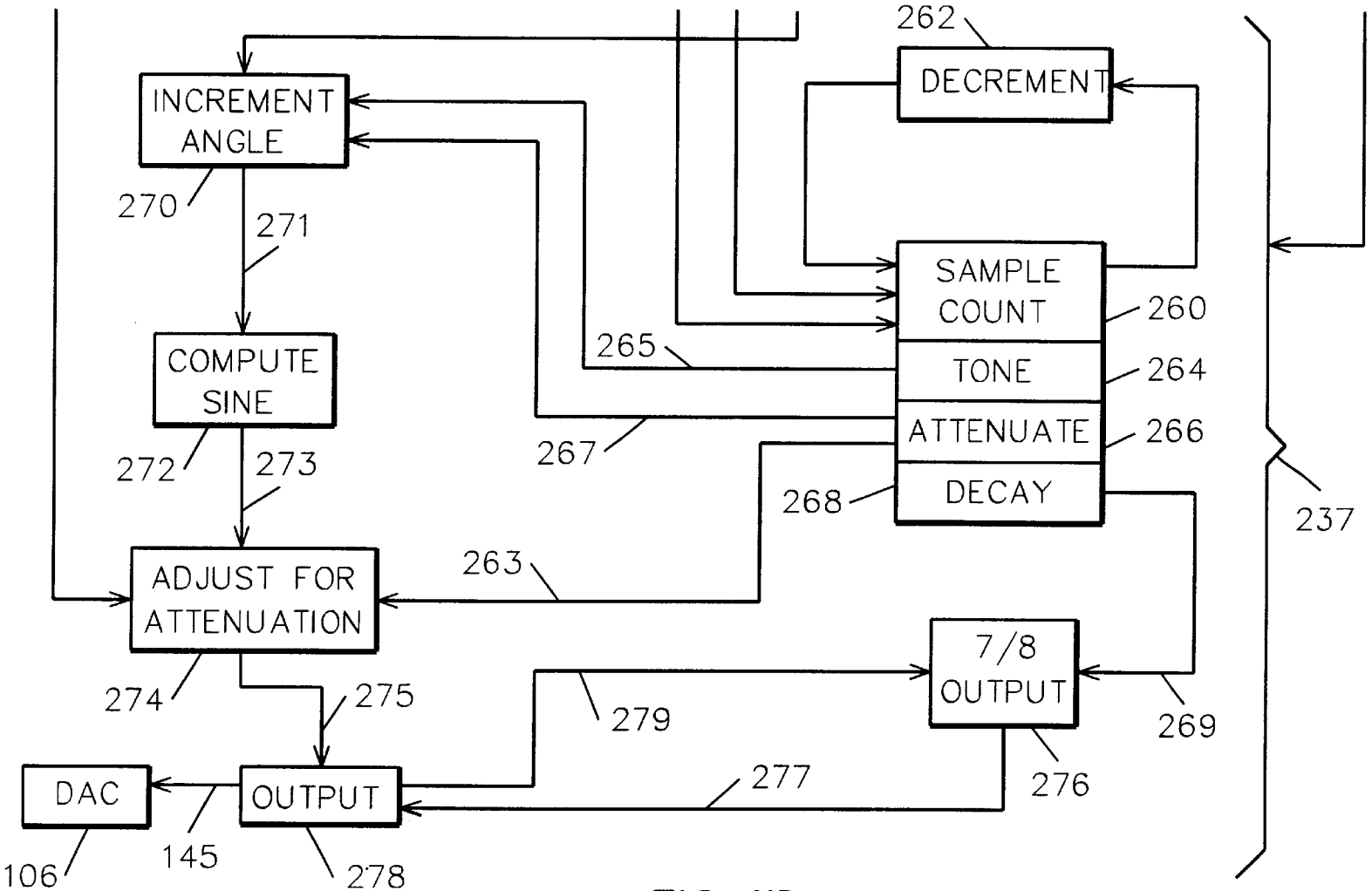

Referring to FIG. 6, the manner in which an angle value is used to select the sine and compute the value of the quadratic is illustrated. This specific embodiment relates to the DSP version set forth in Table 3 at lines 250 through 265. In this preferred embodiment, increment angle logic 270 provides an output signal 271 comprising two sixteen bit half words 287 and 288, including sign bit 285 and index bits 286. Signal 271 is an angle that represent the accumulation of delta T's (ΔT) through the current sample. Compute sine 272 calculates the sine of the angle at the current sample in accordance with the following:

$$\sin(i)=(((a*x)/2)+b)*x)+c \tag{10}$$

where a, b and c are values (in hex) selected from table 238 at the row selected by index value 286 and x is the value 289 selected from bits 5 through 19 of signal 287, with bit position 4 set to zero. The resulting sine value is multiplied by an amplitude (at line 266 of Table 3), rounded and multiplied by the sign of the angle to get the correct quadrant. The result is the output tone, if in the tone period 140 (an not yet executing attenuation). At lines 273 and 274 (Table 3) the code checks if tone period 140 has completed and then branches to an exit routine to wait for the next interrupt on line 135 (FIG. 11). (In DSP code, the instruction after a branch is always executed.) Referring to FIG. 7, a table of tone indexes 242 values 0 through 127 correlated to octave 0 through 10 and notes C (octave 0) through G (octave 10) is illustrated.

An important efficiency of the invention is in value representation. In fixed-point arithmetic only values in the range −2n to 2n−1 can be represented, where n is the register width in bits. If an add operation would result in a value outside of this range, the result is that value minus 2**n (which is a modulo calculation). Sines of angles have this same characteristic. That is, sin(a) =sin(α−2*Π). Thus, by making 2**n =2*Π, all angles α naturally remain in the range 0≦α<2*Π. Since the sine is represented by a piecewise fit, the values of the sine at the required number of points within the fit range can be computed, and the fit done using the mapped angle values. By choosing fit intervals that are a power of 2 in width, mask and shift operations are sufficient to identify the interval, the coefficients to use, and the value upon which to perform the calculation.

For example, with a 32 bit data width and 16 intervals from 0 to Π, the angle α is interpreted as:

| | |
|---|---|
| bit 0: | sign of the result. |
| bits 1–4: | index of the fit interval. |
| bits 5–19: | sine value, x below. |

The approximate sine is calculated as:

$$\text{abs}(\sin(\alpha))=(a*x+b)*x+c \tag{11}$$

where a, b, and c are values obtained from the sine table 238. The sign of the above result can then be changed, if necessary (3rd or 4th quadrant), based upon the bit 0 value. As implemented in the DSP code embodiment of the invention (Table 3), in order to optimize machine components and cycles, the quadratic calculation of the approximate sine is:

$$\text{abs}(\sin(\alpha))=(((a*x)/2)+b)*x)+c, \tag{12}$$

with rounding occurring after (a*x), as implemented at lines 261 through 265 of the DSP code implementation of Table 3.

In the preferred DSP code (Table 3) embodiment of the invention, the table of notes per sampling rate and the table of coefficients of the piecewise fit to the sine are computed and stored either in a ROM or in initialized values of a RAM, thus avoiding code for their calculation in the DSP. The table of notes is calculated as:

$$((2^{**}n)*f)/r \tag{13}$$

where n is the data width, f is the frequency, and r is the sampling rate. In the table, the low order four hex digits are fractional.

During pure tone period 140, a tone output (PCM data) is generated by DSP 102 by calculating the sine of an angle a which is being increased at a constant rate. Each output signal y(i) is computed by adding an increment ΔT to the angle α(i−1), calculating the sine of the angle α(i), then scaling the resulting value to a required range by multiplying by an amplitude multiplier m where m≦1, the initial value of m is determined by the attenuation value index 248, and the attenuation value index 248 is, for example, a three bit binary number selecting one of eight reduction factors.

Thus, during pure tone period 140, the sample value y(i) of the tone generated for i'th sample 141 is given by equation (15), as follows:

$$y(i)=m*\sin(\alpha(i)) \tag{15}$$

where m is derived from the attenuation value index 248, α(i) is the angle, which is i*ΔT, and y is the output value 278.

As will next be described, attenuation of the tone following pure tone period 140 follows the same approach, but the amplitude multiplier m of the output signal is modified, and the output signal is further modified to achieve attenuation in the required time 142, 144.

Tone Attenuation

In general, in accordance with the invention, tone attenuation during attenuate period 142 includes attenuation at zero crossings and attenuation during zero passing zones. This is followed by a decay period 144, followed by stop 146. The attenuation during the attenuate period, particularly within zero passing zones, results in a moderately disturbed but continuous sine of decreasing amplitude.

During tone attenuate period 142, the amplitude m of the tone is reduced at each zero crossing in accordance with equation (16), as follows:

$$m = z*m \text{ where} \tag{16}$$

where z is the attenuation adjustment value for zero crossings, and is set heuristically at some value between approximately ½ and ¾. This adjustment of the attenuation multiplier m is performed prior to the calculation of the first sample following the zero crossing. Thus, ignoring further attenuation adjustments, the next half wave would be of amplitude z*m, and the jth half wave in the attenuation period would have amplitude m*z**j.

Figure 8:
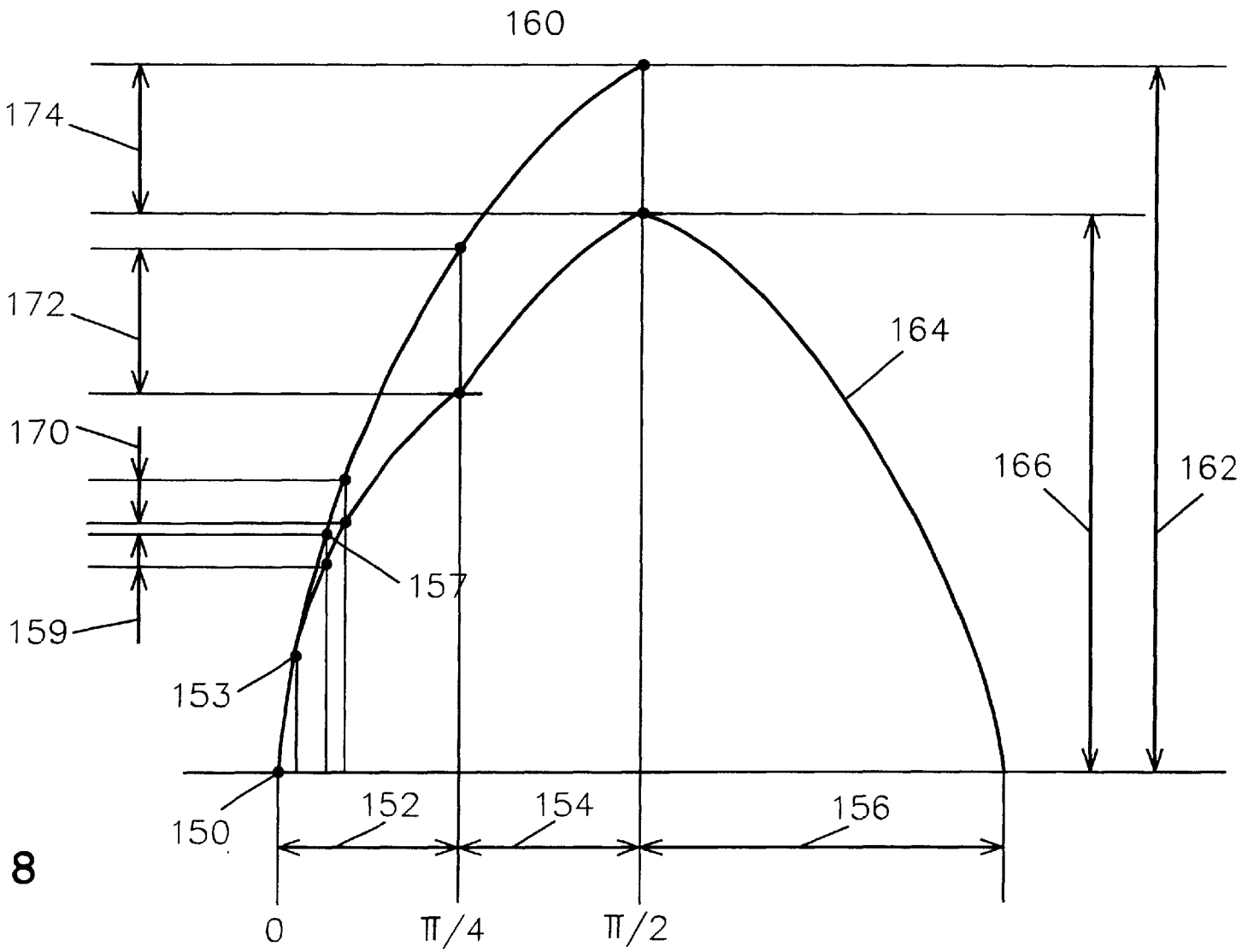
FIG. 8 is a diagrammatic representation of tone attenuation in a sine half wave including a zero passing zone.

Referring to FIG. 8, also during attenuate period 142, the amplitude y(i) of the tone generated is attenuated following each zero crossing (in the zero passing zone, or interval 152). Curve 160 represents y'(i), which equals $$y'(i)=m*\sin(\alpha(i)). \tag{17}$$

The actual y(i), or curve 164 in the zero passing zone 152, is calculated with reference to y' (i) as follows. Let i(0) represent the index of the first sample in the zero passing zone. For the first sample 153 in the zero passing zone, β of i(0)=0, and y(i(0))=y' (i(0)). With respect to the second sample 155 and subsequent samples in zero passing zone 152, bank is derived as follows:

$$\beta(i)=\beta(i-1)+((y'(i)-y'(i-1))-(d**(i-i(0))*(y'(i)-(y'(i-1)) \tag{18}$$

where d is "dampadd" in C code Table 2, y'(i) is "temp", y'(i−1) is "temp1" and d**(i−i(0)) is "damp".

The output y(i) is calculated as follows:

$$y(i)=y'(i)-\beta(i) \tag{19}$$

Bank β(i(0)+1) is represented by value 159. y(i) is curve 164, and y'(i) is curve 160, in intervals 152 and 154.

During interval 152, β(i) is modified according to equation (18). In interval 154, β(i)=(i−1), or in other words, the bank is not modified.

At the boundary between intervals 154 and 156, $$m=m-\beta. \tag{20}$$

In the second and fourth quadrants (interval 156, etc.) the output value y(i) is calculated as follows:

$$y(i)=m*\sin(\alpha(i)). \tag{21}$$

The m in the first quadrant is 162. The m in the second quadrant is amplitude 166, which equals amplitude 162 minus the bank β(i) 172, 174 throughout interval 154, which is a constant value. Value 170 represents the β(i+k), where i+k is some sample time following i(0)+1 in interval 152. Through point 153, curves 160 and 164 coincide.

While the above discussion of attenuation refers to the first and second quadrants of the sine wave, the same principles apply in the third and fourth quadrants.

In the embodiments of Tables 2 and 3, the conclusion of the attenuation period 142 is determined differently. In C code Table 2, the iteration that produces the set of output values is part of the code. For simplicity, the pure tone period 140 and the attenuation period 142 are a single iteration starting at Table 2 line 86 characterized by the computation of a sine. The decay period is a separate iteration starting at line 136.

In DSP code Table 3, the iteration is external, driven by the PLL sample interrupts represented by line 135. The entry point for sample generation is at line 209. The test for decay period occurs at 214 and the branch to decay code occurs at line 215. What was two separate iterations in the C code Table 2, is two separate paths in the DSP implementation.

Figure 9:
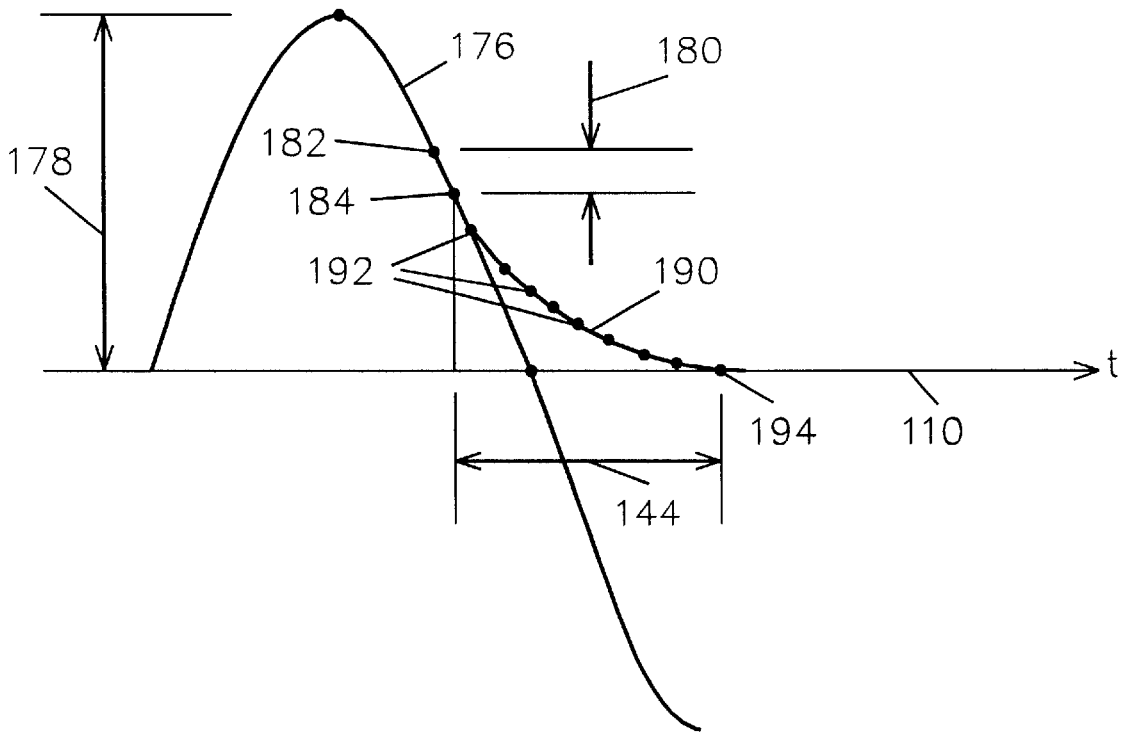
FIG. 9 is a diagrammatic representation of exponential decay while approaching the zero crossing during the decay period.

Referring to FIG. 9, beginning of the decay period 144 at point 184 is recognized when the following three conditions are met:

First, the angle is within the interval $$157.50° \leqq \alpha \leqq 180° \text{ or } 337.5 \leqq \alpha < 180° \tag{22}$$

Second, the damp s is less than dampstep:

$$s \leqq \text{dampstep} \tag{23}$$

where dampstep is a sampling rate related value, and is a bound on the step size that assures that the velocity of the speaker is not too high as decay period is entered. As a speaker 118 velocity related value, it is related to sampling rate (lower for high sampling rates, and higher for low sampling rates). In the DSP code Table 3, this value for dampstep is calculated at line 193 and is a constant in the C code which is only valid for sampling frequency 44.1 Khz. Third, the y(i) at point 184 satisfies the following inequality:

$$6*s \leqq |y(i)| \leqq 8*s \tag{24}$$

where $$s=abs\,(y(i)-y(i-1)). \tag{25}$$

Thus, a value for y(i) is selected to start decay which allows a smooth transition into the decay period from the attenuation period. Thus, the transition to decay is that of a substantially continuous function. This determination is made in similar ways in the C code and DSP code embodiments. In the C code, this calculation is determined as y(i) is less than ⅜ amplitude. In the DSP code, the quadratic is 13 to 15, which is related to the angle (the last ⅜ths of the second or fourth quadrant).

Referring to FIG. 9, exponential decay period 144 generates an exponential decay from the point 184 on sine wave 176 to zero at stop sample point 194 along path 190. Point 184, on sine wave 176 of amplitude 178 in attenuation period 142, is the zero approach point, the first point that meets the three conditions above at equations 22–25 for starting decay.

$$y(i)=\tfrac{7}{8}*(y(i-1)) \tag{26}$$

where ⅞ is a heuristic value for the decay constant. In alternative embodiments, the decay entry conditions and this constant would need to change together in a manner to achieve a smooth transition from the sine wave 176 to the decay curve 190.

At stop 146, which occurs with the sample immediately following the last sample in decay period 144 before the zero crossing, $$y(i)=0. \tag{27}$$

This decay process may be skipped if the attenuation produces two sequential zero value samples for y(i).

Figure 10:
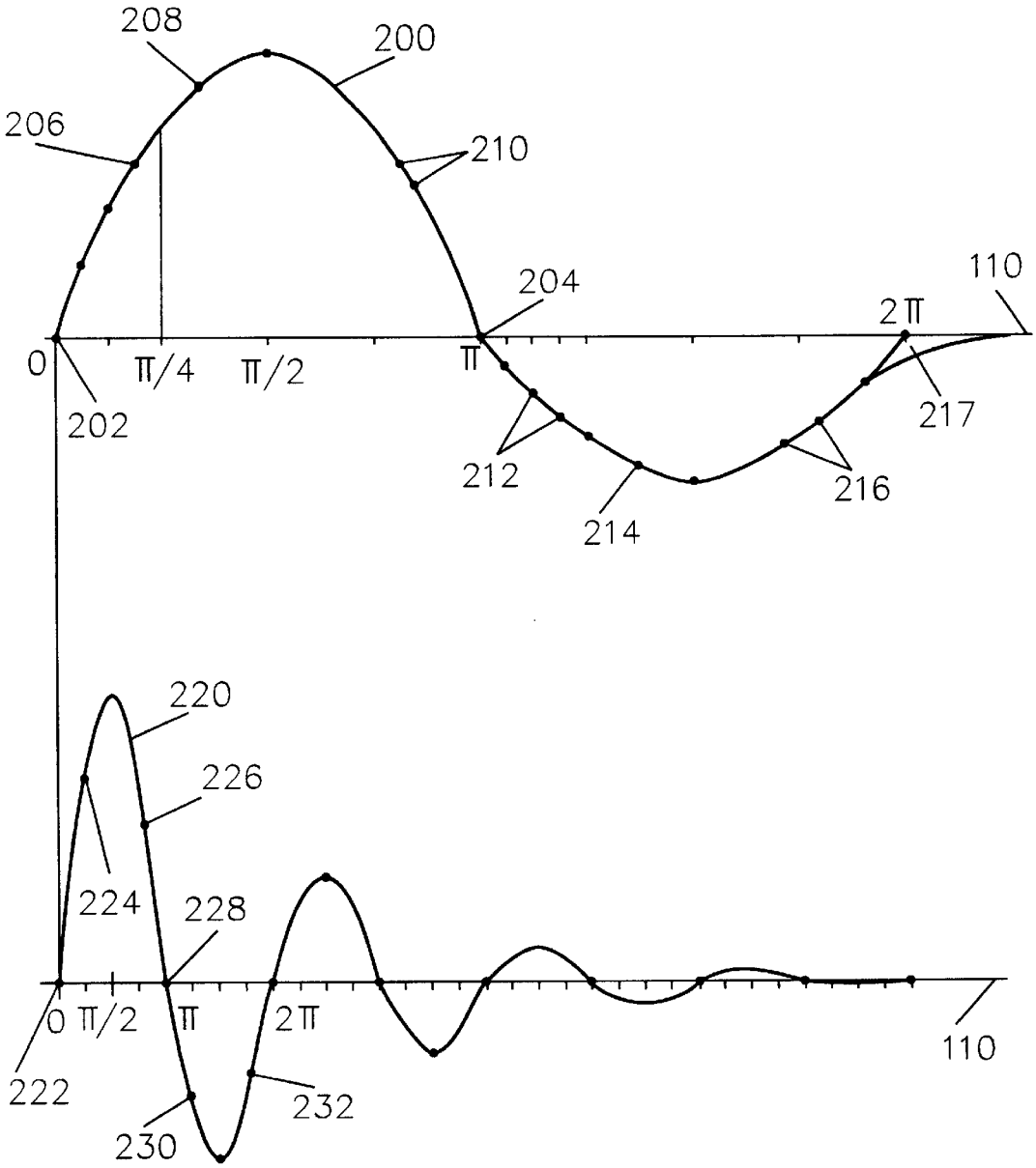
FIG. 10 is a diagrammatic representation of sampling points during attenuation of a lower frequency tone sine wave and during attenuation of a higher frequency tone sine wave.

Referring to FIG. 10, two tones in attenuation are illustrated: one tone 220 of relatively high frequency and the other tone 200 of relatively low frequency. A few illustrative sample points 206, 208, 210, 212, 214, 216 are illustrated along sine wave 200 and points 224, 226, 230 and 232 along sine wave 220. In attenuate period 142, high frequency tone 220 will have (1) many zero crossings 222, 228, . . . ; (2) few consecutive outputs in the first half of the first or third quadrants (no such consecutive outputs are shown in FIG. 10 for tone 220); and (3) a large step size versus output value when tested in the second and fourth quadrants. As a consequence, attenuation of a high frequency tone will be accomplished largely by zero crossing attenuation (factor z, referred to as amplitude control in Table 1). The step control, equivalent to dampadd in the C code, will have no or minor effect, because very few sample points occur in the zero passing zones of the first and third quadrants (shown in FIG. 10 are only sample points 224 and 230 which appear to occur in this zone for tone 220). Inasmuch as successive output values will not meet the requirements to enter exponential decay, attenuation at zero crossings 222, 228 . . . is relied upon to cause the output to go to zero. No exponential decay will occur, and stop will be recognized by two consecutive zero values on the output. (If the tone frequency is close to the sample frequency, two successive zero sample values may occur at zero crossings, but this would be a contradiction of generally accepted tone frequency sampling frequency relationships which require that the tone frequency be something less than the sampling frequency. For instance, in accordance with the Nyquist principle, the highest frequency that can be reasonably produced at a given sampling rate is the sampling rate divided by 2.2.)

Referring further to FIG. 10, in the attenuation period, a low frequency tone 200 will have (1) very few zero crossings 202, 204 . . . ; (2) many consecutive outputs 206, 212 in the first half of the first or third quadrants; and (3) a small step size 180 (FIG. 9) versus output value when tested in the second and fourth quadrants, such as at samples 216. As a consequence, the attenuation of the low frequency tone 200 will be much more effected by the step control ("dampadd") and the low frequency tone will meet the requirements for exponential decay 217 to be applied.

Tones of intermediate frequency are attenuated with a combination of the actions. Thus, if tones of high and low frequency attenuate in the required time, tones of intermediate frequency will also attenuate in the required time.

From the pseudo code of Table 1, it is apparent that none of the control decisions nor the value modifications require more than a few instructions to implement. Also, the number of controls and the number of stored values is also small. This fulfills the objective that the solution be small in both code and data space.

Referring to FIG. 11, which represents the common elements of the three embodiments of Tables 1, 2 and 3 of the system of the invention, digital signal processor 102 of FIG. 1 includes tone request logic 235 and sample generation logic 237.

Host processor 100 inputs to DSP 102, represented by line 241, include sampling index 240, tone index 242, duration index 246, and attenuation value index 248. Alternatively, sampling index 240 may be loaded from audio stream 104. As represented by lines 139 and 243, sampling index 240 is an input to PLL 101, shift value 250, tone table 252 and sample count logic 260. As represented by line 245, tone index 242 is an input to shift value 250 and tone table 252. As represented by line 249, duration index 246 is an input to sample count 260. As represented by line 257, the value m initialized by attenuation value index 248 is an input to adjust for attenuation logic 274. As is represented by line 253, the output of tone table 252 is an input to tone value 254, the output of which is an input represented by line 255 to delta T (ΔT) logic 256. As represented by line 251, the other input to delta T 256 is the output of shift value 250.

Sample count 260 is decremented under control of decrement logic 262. Sample count 260 is initialized by sampling index 240 and duration index 246. Sample 260 is decremented by decrement logic 262 for each sample output produced and to define three states: decremented during tone state 264, which provides a true signal represented by line 265 to increment angle 270 during tone period 140; held at one during attenuate state 266, which provides a true signal represented by line 267 to increment angle 270 during attenuation period 142; held at one during decay state 144, which provides a true signal represented by line 269 to 7/8 output logic 276 during decay period 144; and set to zero on stop state. All interrupts 135 are serviced until sample count 260 is set to zero.

As is represented by line 271, the incremented angle, which is an output of increment angle logic 270, is an input to compute sine logic 272, the output of which, as is represented by line 273, is an input to adjust for attenuation logic 274. As is represented by line 275, the output of adjust for attenuation logic 274 is fed to output latch 278 and on line 145 to DAC 106. As is represented by line 279, the output of output register 278 is fed to 7/8 output logic 276.

In operation, tone request logic 235 receives a tone request from user 100, 104 and prepares to generate a digital representation of the tone by establishing the angle increment value ΔT 256 and generating a request to PLL 101 for sampling interrupts at the frequency specified by sampling index 240. Alternatively, the PLL 101 may be running at a given sampling index in response to an audio stream. Responsive to sample interrupts from PLL 101 on line 135, sample generation logic 237 generates digital representations of the tone signal throughout tone period 148 to DAC 106.

Attenuation value index 248 represents a tone sound level from which factor m is derived, which factor m is the factor used to adjust a maximum possible amplitude to the amplitude desired by the user during tone period 140, and is also the initial value for the amplitude at the beginning 149 of tone attenuation period 142. Index 248 is an index to the initial value of a multiplier on the sine required to take a sine value from the range −1 to +1 into the range −32768 to +32767. (In the preferred embodiment, this entire range is not covered, but is scaled down by about 3 db to keep away from computational edges which prevent calculation of the sine due to changes in sign caused by register overflows.) This index 248 and will be set to "0" for the loudest sound. In the C code implementation of Table 2, the index 248 is not included, but rather the value m is hard coded. In the DSP code implementation of Table 3 (lines 123 through 130), attenuation value index 248 is interpreted as an index into a table of multiplier values representing approximately 3 db increments.

For these embodiments, DAC 106 accepts output values in the range 32,767 to −32,768. However, the system is not limited to 16 bit output, and could be made to accommodate larger output value ranges.

During tone period 140 and also at the beginning of attenuation period 142, adjust for attenuation logic 274 takes the product of computed sine 272 on line 273 and of the attenuation value on line 257, and provides output 278.

Increment angle logic 270 calculates the angle 271 for sample i as the sum of ΔT 256 and angle 271 for the previous sample i−1. ΔT 256 is an increment, a constant angular increment that is used to create sine value 273.

Tone index 242 from processor 100 is used to derive a shift value 250 and to access tone table 252 to derive a tone value 254. Shift value 251 and tone value 254 are used to derive ΔT 256. It is a characteristic of and advantage of the Table 3 DSP code implementation that most of the computational complexity is included in deriving the table of values of ΔT 256, which may now be determined by a selection and a single shift operations.

Referring further to FIGS. 4 and 7, tone index 242 is a value from 0 for C in octave 0 to 127 for G in octave 11. Tone index 242 is taken modulo 12 to give a number 291 in the range 0 to 11, which maps into notes 290, C through B, in tone table 252. Tone index 242 is also divided by 12 to give a value which is subtracted from 10 to give shift value 250. Tone value 254 is shifted right by shift value 250 to obtain ΔT 256. The value ΔT is also represented in FIG. 5, where the angle of this sample i is related to the angle of the previous sample i−1 by the value ΔT:

$$\alpha(i)=\alpha(i-1)+\Delta T. \tag{28}$$

In response to an interrupt on line 135, control is transferred to sample generation logic 237 for the generating a single sample in response to the interrupt, which occur at the frequency (samples per second) specified in sampling index 240. In response to the interrupt, sample generation logic 237 decrements sample count 260, increments angle 271, and computes sine 273. Based on sample count 260, a decision is made to change states 264, 266 and 268 to tone period 140, attenuate period 142, or decay period 144, respectively.

In the DSP code implementation, when in decay state and output signal 279 equals zero, then sample count 260 is set to zero. When in attenuate state, two consecutive outputs are zero, then the sample count is also set to zero. During pure tone period 140 (tone state 264 is true), output 278 is driven by adjust for attenuation logic 274. At any particular time, angle 271 is equal to i * ΔT, where i is the integer label 141, which increases with each sample 141 starting with 0 at the beginning 143 of tone period 140. With each interrupt 135, ΔT is added to the angle for the previous interrupt 141(i−1) to get the angle for the current interrupt 141(i). In C code Table 2, at line 65, "angleinc" is the same as ΔT, except it is in radians. ΔT in the DSP code is "note" in the 65K=2Π units.

Referring further to FIG. 11 in connection with FIG. 2, at the beginning of pure tone period 140, sample count 260 is set to duration index 246 times a value selected by sampling index 240. In the preferred embodiment, the initial sample count 260 value is the number of equal time value durations, expressed in number of samples, set by host processor 100 in duration index 246, minus an average number of attenuation and decay samples, so as to initialize sample count 260 to the number of samples required during pure tone period 140. During pure tone period 140, while sample count 260 is counting down to zero, attenuation value m initialized by attenuation value index 248, drives adjust for attenuation logic 274. When sample count 260 has decremented to zero, attenuation period 142 is entered, sample count 260 is no longer decremented, and adjust for attenuation 274 is driven by m and bank value β 172 (as further described with respect to FIG. 8). Values m and β are modified by selected angles during attenuation period.

Attenuate period 142 is recognized, and attenuate state 266 made true, by sample count 260 being 1 prior to decrementing.

Figures 12, 12A:
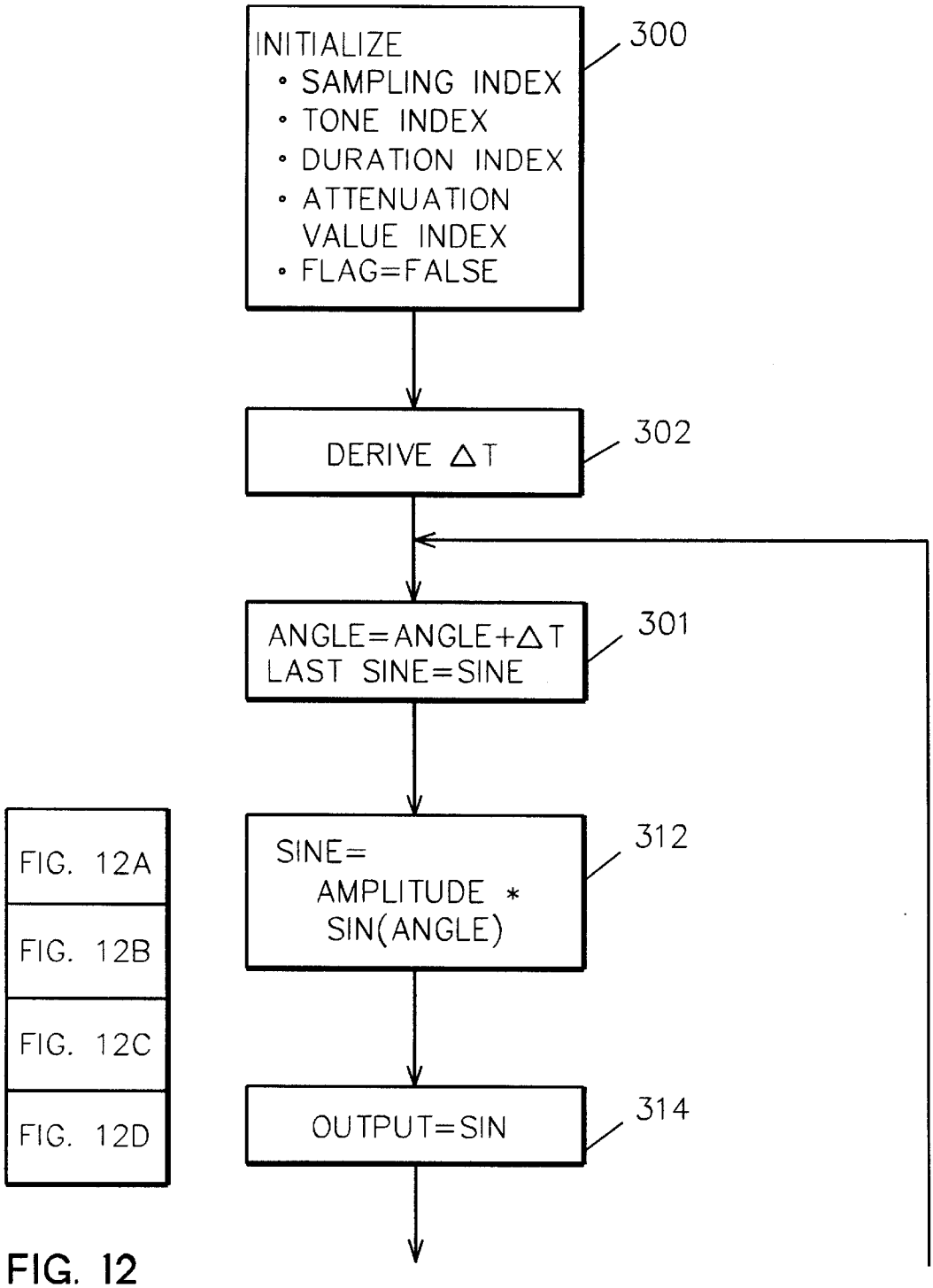
FIG. 12, including
FIGS. 12A through 12D, is a flow diagram of an embodiment of the tone attenuation and decay method of the Table 1 embodiment of the invention.
Figure 12B:
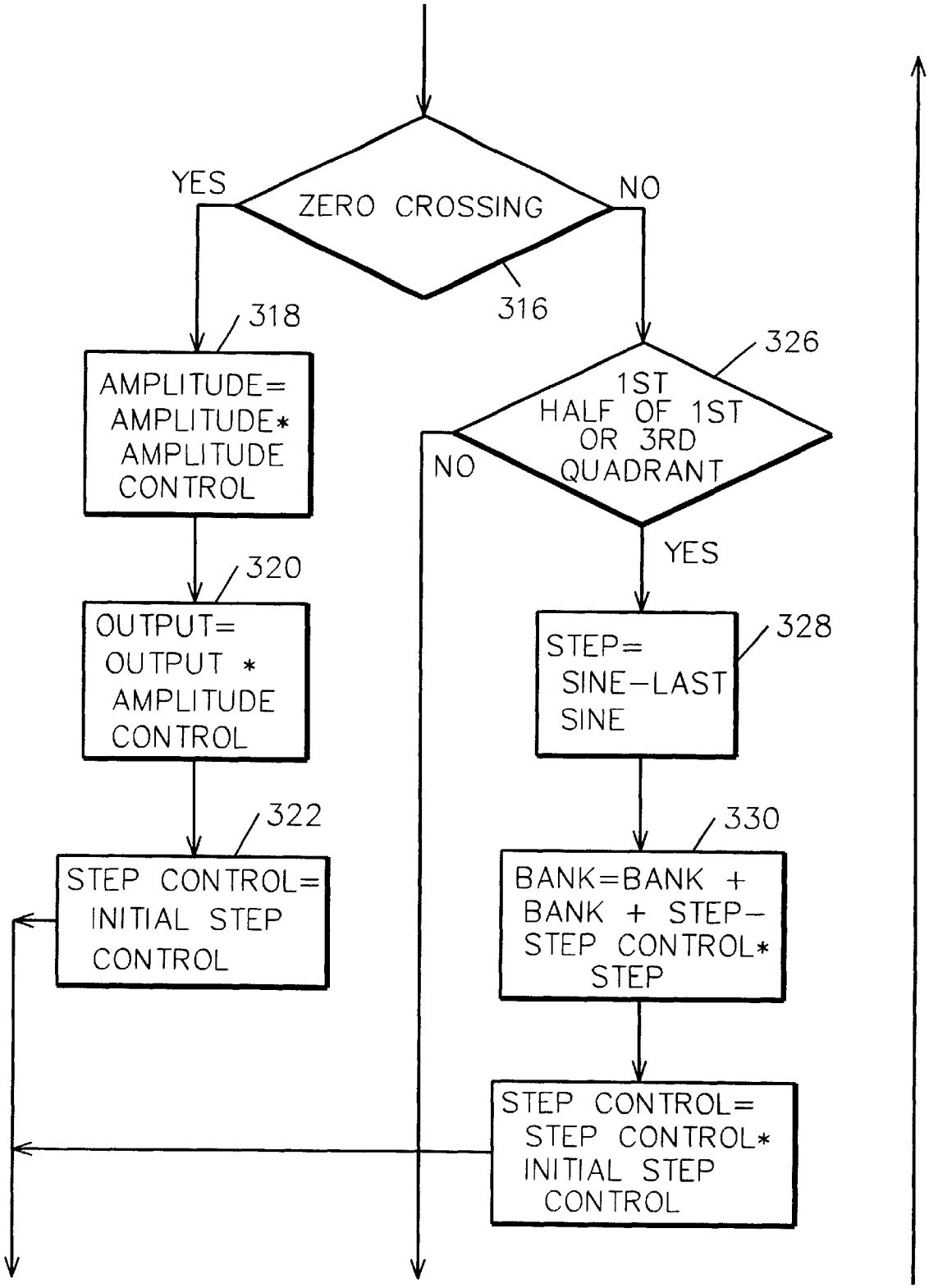
Figure 12C:
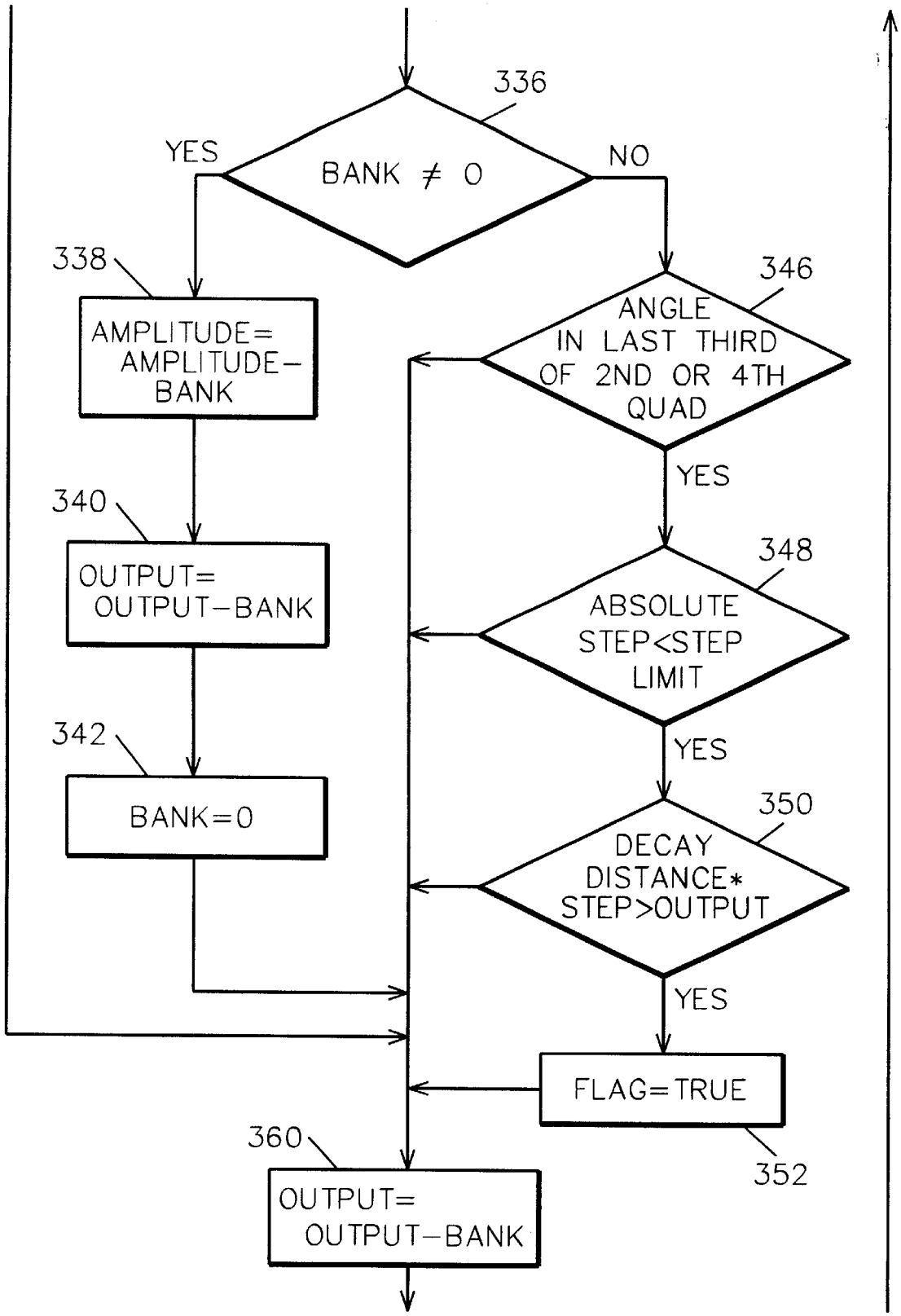
Figure 12D:
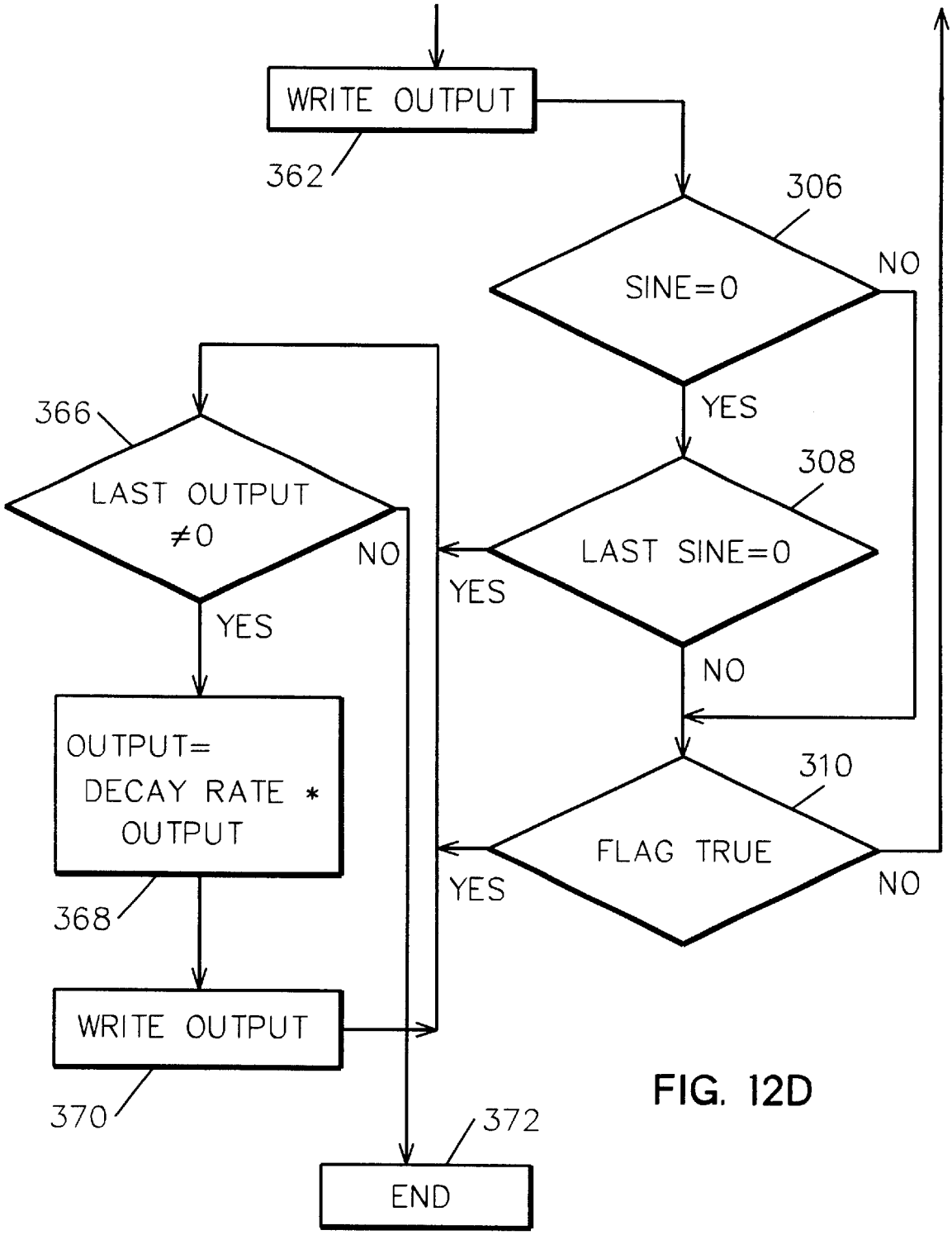

Referring to FIG. 12, including FIGS. 12A through 12D, the method of the invention set forth in the embodiment of Table 1, is illustrated. Selected process steps 300–372 in FIG. 12 are annotated to the code of Table 1. In step 300, a request for a tone is received from processor 100 and the request parameters loaded into sampling index 240, tone index 242, duration index 246 and attenuation value index 248. In step 302, delta T 256 is derived as heretofore explained. The WHILE of line 1 of Table 1 is a representation of the repeated sample interrupts from PLL 101. Processing then continues as set forth in Table 1.

In Table 1, a pseudo-code representation of the tone attenuation and decay methods of the invention is set forth. In this representation of the method of the invention, AMPLITUDE CONTROL is the fraction by which to reduce the amplitude on zero crossings; INITIAL STEP CONTROL is the fraction by which to reduce the step control; DECAY DISTANCE is the step size multiplier that characterizes the decay rate; and DECAY RATE is the fraction by which to multiply the last output to obtain the current output while in exponential decay. The decay rate and decay distance are related as follows:

$$r=\text{decay rate}; \tag{29}$$

$$\text{decay distance}=1/(1-r)=1+r+r^{}2+r^{}3 \tag{30}$$

For example, if decay rate is ⅞ then decay distance is 1/(⅛) or 8.

TABLE 1

| | Pseudo-Code Representation |
|---|---|
| 306 | UNTIL ((CURRENT SINE IS EQUAL TO ZERO) AND (LAST SINE IS EQUAL TO ZERO) OR (FLAG)); |
| | LAST SINE = SINE; |
| 312 | SINE = AMPLITUDE * SIN(ANGLE); |
| 314 | OUTPUT = SINE; |
| 316 | IF SINE JUST CROSSED ZERO, |
| | THEN DO: |
| 318 | AMPLITUDE = AMPLITUDE * AMPLITUDE CONTROL; |
| 320 | OUTPUT = OUTPUT * AMPLITUDE CONTROL; |
| 322 | STEP CONTROL = INITIAL STEP CONTROL; |
| | END; |
| 326 | ELSE IF SINE IS IN THE FIRST HALF OF THE FIRST OR THIRD QUADRANT, |
| | THEN DO: |
| 328 | STEP = CURRENT SINE − LAST SINE; |
| 330 | BANK = BANK + STEP − STEP CONTROL * STEP; |
| 332 | STEP CONTROL = STEP CONTROL * INITIAL STEP CONTROL; |
| | END; |
| 336 | ELSE IF REDUCTION IS NOT ZERO, |
| | THEN DO: |
| 338 | AMPLITUDE = AMPLITUDE − BANK; |
| 340 | OUTPUT = OUTPUT − REDUCTION; |
| 342 | BANK = 0; |
| | END; |
| 346 | ELSE IF ANGLE IS IN THE LAST THIRD OF THE SECOND OR FOURTH QUADRANT, |
| 348 | THEN IF ABSOLUTE STEP < STEP LIMIT, |
| 350 | THEN IF DECAY DISTANCE * STEP = OUTPUT, |

TABLE 1-continued

| Pseudo-Code Representation |
|---|
| 352 THEN FLAG = TRUE; |
| 360 OUTPUT = OUTPUT − BANK; |
| 362 WRITE OUTPUT; |
| 364 ANGLE = ANGLE + ANGLE INCREMENT |
| END; |
| 366 WHILE (LAST OUTPUT IS NOT ZERO) |
| 368 OUTPUT = DECAY RATE * OUTPUT; |
| 370 WRITE OUTPUT; |
| 372 END; |

TABLE 2

Beep Generation I (C-Code)

```
#include    <stdio.h>
#include    <string.h>
#include    <math.h>
void main()
{
    int i, octave, note;
    int index;
    int newdelta;
    int ampi;
    int bank;
    int points;
    int diff;
    int j;
    int tlim;
    int anglep, angleint;
    int short temp;
    int short temp1;
    int short out;
    double cycle;
    int duration = 7;
    int dursamp;
    double ffreq[12];              /* computed frequency of highest
    double angle;                  tones */
    double angleinc;
    double damp;
    double samp = 44110.0;         /* sampling rate */
    int dampstep = 110;
    double dampinit = .625;        /* 5000 / 8000 */
    double dampadd = .9863281;     /* 7E40 / 8000 */
    int zize;
    int flg;
    /* angle increments for other sampling rates obtained
    /* by modifying variable "samp" above */
    int notes[12];                 /* computed angle increments */
    double PI;
    char out_name[64] = ("pcmout.pcm");
    FILE *fopen(), *pcmout;
    /* compute highest frequency tone increments from an "A" =
    440 * 2**5 */
    angleinc = pow(2, (double)1/12);
    ffreq[9] = 14080.0;
    ffreq[10] = ffreq[9] * angleinc;
    ffreq[11] = ffreq[10] * angleinc;
    for (i=8; i>=0;i--) ffreq[i] =
      ffreq[i + 1] / angleinc;
    for (i=0;i<12;i++) notes[i] = ffreq[i] *
      (65536.0 * 65536.0 / samp) + .5;
    PI = 3.14159265358979;
    pcmout = fopen*(out_name,"wb");
    j = 46;                /* can change to generate other tones */
    ampi = 0x00005a82;     /* .707107 . . .
    index = j;
    octave = index / 12;   /* convert tone index into note and
                           /*octave */
    note = index % 12;
    /* calculate angle increment for the tone in double and
    /* int.
    /* calculate tone cycles per second for information and
    /* reference. */
    angleinc = notes[note] / 65536.0;
    for (i=10;i>octave;i--) angleinc / = 2;
```

TABLE 2-continued

Beep Generation I (C-Code)

```
    cycle = (samp * angleinc)/(65536.0);  /* for reference */
    anglep = angleinc * 65536.0;          /* int value of angle in DSP */
                                          /* solution, 65536 = 2* PI */
    angleinc = angleinc * 2 * PI / 65536;
    /* generate cycle Hz tone at samp Hz sampling  */
    /* freguency for duration / 10 sec              */
    points = 0;
    temp1 = 0;
    angle = 0;
    dursamp = (duration * samp )/10.0;
    for (i=0; i<dursamp; i ++)
      {
        templ = temp;
        temp = ampi * sin((angle));
        angle = angle + angleinc;
        angleint = angleint + anglep;
        if (angle > 2*PI) angle = angle − 2*PI;
        zize=fwrite(&temp,sizeof(temp),1,pcmout);
        points++;
      }
    /* attenuate tone */
    bank = 0;
    damp = dampadd;            /* start damping if in 1st or */ /* 3rd
    quadrant */
    flg = 0;
    while (temp!=0 || temp1!=0)
      {
        temp1 = temp;
        temp = ampi * sin((angle));
        /* if crossing zero, change amplitude, adjust */
        /* temp, initialize additional damping values */
        if (temp / abs(temp) !=templ / abs(temp1))
          {
            ampi = ampi * dampinit;
            temp = temp * dampinit;
            damp = dampadd;
          }
        /* if going away from zero, newdelt=damp*delta */
        /* must do compare on angles on high frequency */
        /* tones */
        else if ((0.0<angle&&angle<PI/2.0) ||
                  PI < angle&&angle<3.0PI/2.0))
          {
            newdelta = temp − temp1;
            bank = bank+newdelta − (int) (newdelta*damp);
            /* if damp > .4) */
            if (abs(temp1) < (71*ampi)/100)
              damp = dampadd * damp;
          }
          /* check if just changed direction       */
          /* crossed PI/2 or 3P1/2                 */
          else if (bank)
            {
              ampi = ampi − abs(bank);
              temp = temp − bank;
              bank = 0
            }
            /* check if nearing zero, angle nearing    */
            /* zero or PI                              */
            else
              {
                if (abs(temp) < 3*ampi/8
                  if (abs(temp − temp1) <= dampstep)
                    if( (8*abs(temp − temp1)>=abs(temp)) &&
                    (abs (temp)>= 6*abs(temp-temp1))
                      flg = 2;
              }
        out = temp − bank;
        angleint = angleint + anglep;
        angle = angle + angleinc;
        if (angle > 2*PI) angle = angle − 2*PI;
        zize = fwrite(&out,sizeof(temp),1,pcmout);
        points++;
        If (flg ==2) break;
      }
    /* exponential decay to zero */
    while (temp1 != 0)
```

TABLE 2-continued

Beep Generation I (C-Code)

```
        {
            temp1 = temp;
            temp = (7*temp1)/8;
            zize=fwrite(&temp,sizeof(temp),i,pcmout);
            points++;
        }
    /* add some trailing zeros to guarantee a quite moment */
    for(i=0;i<1024;i++)
        {
            zize=fwrite(&temp,sizeof(temp),1,pcmout);
        }
}
```

Referring to Table 3, the DSP assembly language embodiment of the invention is set forth. The DSP code implementation differs from the C code implementation of Table 2 in that in the DSP code a change in sampling frequency during the tone generation period is accommodated without changing the audible tone. The output of DAC 106 will be substantially the same for small changes in sampling frequency. For instance, a change from a sampling frequency of 44.1 KHz to 48 KHz is not detectable by a human. The C code implementation supports only a single sampling rate (44.1 KHz). Also, it computes some of the table values that the DSP code reads. For example, the sine is computed by the system in the C code implementation, rather than by the spline fit table used by the DSP code. A pseudo code representation of the algorithm executed by DSP code is set forth in Table 3 at lines 26 through 86, and the remainder of the code is generously commented. The DSP code language syntax used in Table 3 is described in "*Mwave Development Tookkit, Assembly Language Reference Manual*", Intermetrics, Inc, Cambridge, Mass., copyright 1992, 1993.

TABLE 3

Beep Generation II (DSP Code)

```
8   ;*****************************************************************************************
9   ;* Beep generation code
10  ;*
11  ;*          Not & subroutine, strictly speaking, since it does not return to the
12  ;*          caller. Split off like this to make it easier to move to RAM.
13  ;*
14  ;* NOTE: Don't need to make the return statement flexible, since if we move
15  ;*          this code to RAM, it will already return to the correct spot. If
16  ;*          Sample gets moved to RAM, this code is still useable, since
17  ;*          nothing really gets done after this routine finishes.
18  ;*
19  ;* Variables                    Description
20  ;* ---------                    -------------
21  ;* nnotes                       The angular increment for the comment note in the
22  ;*                                highest octave.
23  ;* dur_mult                     The number of samples at 48K times dur_mult / 800 base
24  ;*                                16 is the number of samples at the actual sampling
25  ;*                                frequency.
26  ;* dur_recp                     The number of samples at the actual frequency *
27  ;*                                dur_recp / 8000 base 16 is the number of samples
28  ;*                                at 48K. These are approximate.
29  ;* atndcay                      Maximum step size to switch to decay in 2nd or 4th
30  ;*                                quadrants.
31  ;*
32  ;*****************************************************************************************
33  ;* Tone Initialization and Play
34  ;*      on entry to initializaion, r1 = contents of PCM_CON,
35  ;*          encoded duration and attenuation
36  ;*
37  ;* Tone Initialization
38  ;* - Calculate attenuation from attenuation index in PCM_CON.
39  ;* - Calculate note and octave from tone index in AUD_CTL.
40  ;* - Initialize angle to zero.
41  ;* - Save sampling rate.
42  ;* - Calculate duration from sampling rate.
43  ;* - Sampling rate change reentry point.
44  ;* - Calculate note from noteidx.
45  ;* - Copy controls that are rate dependent
46  ;* - Fall thru into tone pre-process.
47  ;*
48  ;* Tone Process
49  ;*      on entry, wr2 contains duration
50  ;* - If final < 1
51  ;* -        then out = lastsamp * final
52  ;* - Else if sampling rate is not the same,
53  ;* -        then
54  ;* -            compute new duration
55  ;* -            branch to tone initialization reentry point
56  ;* -        end
57  ;* -        Save sign of angle
58  ;* -        Add note to angle
```

TABLE 3-continued

```
59  ;* -        Save sign of updated angle
60  ;* -        out = ampi * sine of angle
61  ;* -        If duration−1 > 0
62  ;* -          then duration = duration − 1
63  ;* -          else
64  ;* -            out = out − bank
65  ;* -            if angle crossed 0 to PI
66  ;* -              then
67  ;* -                ampi = ampi * zero_atn
68  ;* -                out = out * zero_atn
69  ;* -                damp = tone_damp
70  ;* -              end
71  ;* -            else
72  ;* -              if angle is in 1st or 3rd quadrant
73  ;* -                then
74  ;* -                  out = out − (out − lastsamp) * (1 − damp)
75  ;* -                  bank = bank + (out − lastsamp) * (1 − damp)
76  ;* -                  if in 1st quadrant and angle < 3 PI / 8 OR
77  ;* -                          in 3rd quadrant and angle < 11 PI / 8
78  ;* -                        then damp = damp * tone_damp;
79  ;* -                end
80  ;* -              else
81  ;* -                ampi = ampi − abs(bank)
82  ;* -                bank = 0
83  ;* -                if in 2nd quadrant and angle > 3 PI / 4 OR
84  ;* -                      in 4nd quadrant and angle > 7 PI / 4
85  ;* -                  then if abs(out − lastsamp) < tone_step AND
86  ;* -                                8 * abs(out − lastsamp) >= abs(out)
87  ;* -                        then final = 7/8;
88  ;* -              end
89  ;* -            end
90  ;* -          end
91  ;* - end
92  ;* - Store out in left / right output register sources
93  ;* - Return
94  ;*
95  ;*****************************************************************************************************
96  ;* Tone constants storage map:
97  ;*
98  ;* RATE        NOTES          CONVDUR      DURAT    ATNSAMP    ATNSTEP    ATNDCAY    UNUSED
99  ;* 00 00000    48                 6          2          2          2          2          2
100 ;* 01 000000
101 ;* 10 000000
102 ;*
103 ;*****************************************************************************************************
104 ;*
105 ;* Hardware registers
106 ;*
107 ;*                  1  1  1  1  1  1
108 ;*                  5  4  3  2  1  0  9  8  7  6  5  4  3  2  1  0
109 ;*
110 ;* PCM_CON          X  X  X  D  D  D  D  D  X  r  r  r  X  A  A  A
111 ;* AUD_CTRL         r  T  T  T  T  T  T  T  r  r  r  r  r  r
112 ;* FSCR_REG         X  X  X  X  S  S  R  r  r  r  r  r  r  r
113 ;*
114 ;*  r - reserved          X - not relevant
115 ;*  D - duration          A - attenuation          T - tone index
116 ;*  S - sampling rate     R - sampling range
117 ;*
118 ;*****************************************************************************************************
119 atn_samps      equ   80                    ; 320 / 4
120 ;PCM.Beep_Req   equ '1f00'x                 ; mask to extract duration
121 min_tone         equ 26                    ; minimum tone index in attenuation
122 ; Expects r1 = PCM_CON
123 toni           equ *
124 ; calculate tone attenuation from index, clear tone_dcay
125                r6=#7          %r2
126                CDB=r1         r6=r6&r1
127                BIB 0, toni10                      ; branch LSB attenuation
128                r3='4000'x                         ; n * 6 dB attenuation
129                r3='2d41'x                         ; n * 3 dB attenuation
130 toni10         equ *
131                                                   ;        0/1  2/3  4/5  6/7
132                r6=SHR1(r6)                        ; r6=r6/2,   0,   1,   2,   3
133                r7=#3
134                               r6=r6−r7
135                r3=r3*2**r6
136                ampi=r3
137                tone_ash=r6
```

TABLE 3-continued

```
138     ; calculate duration in standard form, 48K sampling rate
139                     r7=#PCM.Beep_Req
140                     r5='004b'x      r1=r1&r7                ; r5 = 4800 / 64
141                     r7=#atn_samps                   r5*r1   ; r1 = duration * 256
142                                                             ; r7 = attenuation samples / 4
143                             wr2=rp                          ; wr2 = duration * 4
144                     wr2=SL(wr2,12)                          ; r2 = duration / 4
145                     r7=#'00e0'x     r2=r2-r7                ; adjusted duration / 4
146     ; prepare sampling rate
147                     r3=_FSCR_REG
148                     r3=SL(r3,-4)
149                     r5=#0           r3=r3&r7
150     ; clear tone_dcay and angle
151                     tone_dcay=r5
152                     angle=r5
153                     angle+2=r5
154                     r1=_AUD_CTRL                            ; load tone index
155                             r1=r1+r1                        ; isolate note index
156                     r1=SL(r1,-9)
157                     tone_cur=r1                           ; save for sampling rate change
158     ; sampling rate change reentry point
159     ; - r1 = tone_cur
160     ; - r2 = duration at 48K divided by 4
161     ; - r3 = FSCR_REG shifted right 4 bits
162     toni25          equ *
163     ; convert 48K duration to duration for current sampling rate
164                     r0='00c0'x                              ; isolate rate selector
165                             r0=r0&r3
166                     oldfscr=r3
167                     r5=dur_mult[r0]                         ; duration conversion
168                             %r4             r5|*|r2
169                             wr2=rp
170                     wr2=SL(wr2,-13)
171                     rS='1556'x
172                     r5=#48                          r1*r5   ; tone index * 1/12 to RPH
173                     r1=#-10         r4=r4+rpl               ; remainder to r4
174                             r1=r1+rph       r5|*|r4         ; r1 = shift amount,
175                                                             ; RPH = 4 * tone index % 12
176                     r6=tone_ash                             ; reload attenuation shift
177                     r5=atndcay[r0]                          ; load decay steps
178                     r4=atnstep[r0]                          ; step attenuation factor
179                     r5=r5*2**r6                             ; shift by attenuation level
180                             r0=r0+rph                       ; note address
181                     r7=#'7fff'x
182                     r6=nnotes+2[r0]                         ; note + 2
183                     wr6=SL(wr6,-16)
184                     r6=nnotes[r0]                           ; note
185                     CDB=r3
186                     BIB 5,toni40
187                     wr6=wr6*2**r1
188                     wr2=SL(wr2,-1)                          ; halve duration samples
189                     wr6=SL(wr6,1)                           ; double note increment
190                     r5=SL(r5,1)                             ; double decay step size
191                     r4=SL(r4,1)                             ; double step attn factor
192     toni40          equ *
193     tone_step=r5                    ; decay step size limit
194                     r4=r4&r7        ; clear possible sign bit
195     damp=r4                         ; initialize damp
196     tone_damp=r4                    ; step damping factor
197     note=r6
198     note+2=r61
199                             wr2=%+wr2+1                     ; guarantee duration ^= 0
200     ; can remove after testing
201                     tone_dur=r2                             ; save duration
202                     tone_dur+2=r21
203     ;* Continues on with the rest of Beep code, now that the initial setup
204     ;* work has been done!
205                             ; This is the tone 'continuation' point. Come here
206                             ; if a tone is already playing.
207                             ; Expects that wr2 has the double word value
208                             ; for Tone Duration loaded.
209     tone            equ *
210                     r3=_FSCR_REG                            ; r3 = current sampling rate
211                     r3=SL(r3,-4)                            ;      index * 2
212                     r5=tone_dcay
213                     r7=oldfscr
214                     r1=#'00e0'x     r5                      ; if decaying, go to decay code
215                     bnz tone10      r3=r3&r1                ; isolate sampling rate
216                     r6=#'000f'x     r3<>r7                  ; if sampling rate same
```

TABLE 3-continued

```
                    bz   tone15     r0=r6                    ;       continue
                    r6=angle
;                   oldfscr=r3                               ;
; start to recompute set-up
; convert current duration to standard form
; r1 = old rate, r3 = new rate
toni50              equ *
                    r0=#'00c0'x
                    CDB=r7          r0=r0&r7                 ; isolate rate
                    BIB 5,toni60                             ; branch if high rate range
                    wr2=SL (wr2,14)
                    wr2=SL(wr2,1)                            ; extra shift if low
toni60              equ *
                                                             ; note: if 1 < tone_dur < 3
                                                             ;     r2 will be 0
                                                             ; adjusted to 1 after toni25
                    r5=dur_recp[r0]                          ; conversion reciprocal
                                            r5|*|r2          ;
                                r2=rpm                       ;
                                                             ;
                    b toni25
                    r1=tone_cur
; exponential decay to zero
tone10              equ *
                    r1=lastsamp                          ; sample = lastsamp * decay
                                        r5*r1            ; test lastsamp
                                r1=rpm
                    bz   tone80                              ; if sample = 0, tone completed
                    bnz  tone91                              ; else standard exit
                                r1=%+r1+SGN                  ; add 1 to negative value only
tone15              equ *
;                   r6=angle                                 ; above
                    r61=angle+2
                    r7=SIG r6                                ; r7 = sign of angle
                    rph=note                                 ; angle = angle + note
                    rpl=note+2
                                wr6=wr6+rp
                    angle=r6
                    angle+2=r61
                    r3=SIG r6                                ; r3 = sine of angle + note
; compute sine of angle
; requires that quadratic "c" value be multiplied by 2
; separate angle into    S Q Q Q Q X X X X X X X X X X X
; S - sign, Q - quadratic index, X - value    sine = Q(X)
                    wr6=SL(wr6,-11)                          ; shift
;                   r0=#'000f'x                              ;     above
                    r6=#0           r0=r0&r6                 ; isolate offset
                                    r0=r0+r0
                    wr6=SL(wr6,15)                           ; isolate X
                    r0=&qa[r0]                               ; address of quadratic
                    r1=ampi                                  ; amplitude
                    r5=qa-qa(r0)                             ; a
                    r5=qb-qa(r0)    tnop            r5*r6    ; b, a * x
                                    r5=r5+rpm+rd             ; a * x + b
                    r5=qc-qa(r0)                    r5*r6    ; c, (a * x + b) * x
                                    r5=5+rph+1               ; (a * x + b) * x + c + 1
                                                    r1|*|r5  ; multiply * attenuation / 2
                                    r5=rpm+rd
                    r5=#1                           r3*r5    ; multiply by sign
                                    r1=rpl          r5*r5
; have ampi * sine(angle)
; decrement for duration
                    r6=#min_tone    wr3=wr2-rp      mnop     ; duration = duration - 1
                    bnz tone90                               ; if not zero, normal exit
                    tone_dur=r2
; attenuation phase
                    r2=tone_cur
                    r4=oldfscr
                    r5=#1           r2<>r6                   ; if tone_cur >= tone_min
                    bnl  tone20     r4=r4+r5                 ;     then branch, no adjustment
                                    r2=r2+r5                 ; increase tone index
                                                             ; force miscompare without
                    oldfscr=r4                               ;     changing rate
                    tone_cur=r2                              ; save updated tone
; did sine cross zero in interval?
tone20              equ *
                                r3<>r7                   ; sign of last angle vs current
                    bne tone70                               ; branch if changed
                    r7=bank                                  ;
```

TABLE 3-continued

```
296                     r6=#16          r1=r1−r7                ; sample = sample = bank
297                     r4=lastsamp
298                     r6=#12          r0<>r6                  ; compare quadrant
299                     bnl tone40      r4=r4−r1                ; branch 2nd or 4th quadrant
300                                     r7                      ;     temp = (samp − lastsamp)
301                                                             ; test bank
302     ; first or third quadrant
303                     r5=damp
304                                             r4*r5           ; t1 = tamp * damp
305                                     r4=r4−prm−rd            ; temp = temp − t1
306                                     r1=r1+r4                ; samp = samp − temp
307                                     r7=r7−r4                ; bank = bank + temp
308                                     r0<>r6                  ; is angle >= 67.5 degrees
309                     bnl  tone30     r4=r5                   ; branch yes, r4 = damp
310                     bank=r7
311                     r5=tone_damp                            ;
312                                             r4*r5           ; damp damp * dampatn
313                                     r4=rpm+rd
314     tone30          equ *
315                     b tone91
316                     damp=r4
317     ; second or fourth quadrant
318     tone40          equ *
319                     bz tone50       %r2                     ; if bank ^= 0
320                     bank=r2                                 ; bank = 0
321                     r5=#'5a82'x                             ; adjust for full scale
322                                     r7=|r7|                 ; |bank|
323                                             r5*r7           ; |bank| * full scale value
324                     r3=ampi
325                                     r3=r3−rpm               ; ampi = ampi − bank
326                     b tone91                                ;
327                     ampi=r3
328     tone50          equ *
329                     r3=#28          r4=|r4|
330                     r7=tone_step                            ;
331                     r5=#6           r0<>r3                  ; test decay start angle
332                                                             ; branch if not near end
333                                                             ;        of quadrant
334                     bl tone91       r4<>r7                  ; step <> decay step
335                                             r5*r4           ; 6 * |step|
336     ; test if 6*|step| <= |sample| <= 8*|step|
337                     r4=SL(r4,3)                             ; 8 * |step|
338                                                             ; branch if step is too large
339                     bh tone91       r3=|r1|                 ;     |sample|
340                                     r4<>r3                  ; 8 * |step| <> |sample|
341                     bl   tone91                             ; branch |sample| > 8*|step|
342                     r2=#'7000'x
343                                     r3−rpl                  ; |sample| − 6*|step|
344                     bn   tone91                             ; branch |sample| < 6*|step|
345                     bnn  tone91                             ; branch in range
346                     tone_dcay=r2                            ; start decaying
347     ; sine crossed zero and attenuating
348     tone70          equ *
349                     r3=tone_damp                            ; reinitialize damp
350                     damp=r3
351                     r3=ampi
352                     r5=zero atn
353                                             r1*r5           ; adjust sample value
354                                     r1=rpm+rd       r3*r5   ; adjust attenuation
355                                     r3=rpm
356                     bnz  tone91                             ; no duration update exit
357                     ampi=r3
358                                                             ; ampi = 0
359                                                             ; set duration = 0 − end of tone
360     tone80          equ *
361                                     wr2=wr2−wr2             ; force duration to zero
362     tone90          equ *
363                     tone_dur+2=r21
364     tone91          equ *
365                     lastsamp=r1
366                     __SMP_F0=r1                     ;                                       @13A
367                     b SMP_EXIT      ;* this is the end of Beep. Returns control here.
368                     __SMP_F1=r1                     ;                                       @13A
        ==========================================================================================
```

TABLE 4

```
==========================================================
                    Quadratics Sine Fit Table
==========================================================
;* coefficients - 16 piecewise continuous quadratics fitted to sine of 0 to PI
   ROM 'qa',        'ff51','fdfa','fcb6','fb94','fa9c','f9da','f954','f90f'
   ROM '',          'f90f','f954','f9da','fa9c','fb94','fcb6','fdfa','ff51'
   ROM 'qb',        '4750','45f1','41e1','3b49','326a','279b','1b46','0de5'
   ROM '',          'fffc','f212','e4b2','d85e','cd90','c4b2','be1c','ba0e'
   ROM 'qc',        '0000','2351','4546','6492','8000','9683','a73d','b18b'
   ROM '',          'b505','b18b','a73d','9683','8000','6492','4546','2351'
==========================================================
```

TABLE 5

```
==============================================================================
                          Tone Constants Storage Map
==============================================================================
;******************************************************************************
;* Tone constants storage map:
;* RATE        NOTES                dur_mult    dur_recp    atnstep    atndcay    unused
;* 00 000000    48                     2           2          2          2          8
;* 01 000000
;* 10 000000
;*
;* Variables include:
;*        nnotes                 The angular increment for the comment note in the highest
;*                                octave.
;*        dur_mult               The number of samples 48K times dur_mult / 8000 base 16
;                                 is the number of samples at the actual sampling
;                                 frequency.
;******************************************************************************
;* american pitch, A=440 cps
;*            first note set is "C", note is an angle increment in dword
;* 44.1K values
;*                                C          C#          D          D#
        ROM 'nnotes ',      '3099','76df','337d','45b6','368d','1251','39cb','7a59'
;*                                E          F           F#         G
        ROM '',             '3d3b','4348','40df','5cc9','44ba','e33a','48d1','2253'
;*                                G#         A           A#         B
        ROM '',             '4d25','97f5','51bb','f72d','5698','2b55','5bbe','5b72'
        ROM 'dur_mult',     '759a'
        ROM 'dur_recp',     '8b52'
        ROM 'atnstep',      '7ccd'
        ROM 'atndcay',      '00b0'
        ROM '',             '0000'
        ROM '',             '0000'
        ROM '',             '0000'
        ROM '',             '0000'
;*
;* 48K values
;*                                C          C#          D          D#
        ROM '      ',       '2ca6','986a','2f4e','4b3f','321e','68d4','3519','5868'
;*                                E          F           F#         G
        ROM '',             '3841','a5d1','3b9a','03a6','3f25','4d91','42e6','8abc'
;                                 G#         A           A#         B
        ROM '',             '4Ge0','f069','4b17','e4b1','4fBf','016a','544a','1737'
        ROM '      ',       '8000'
        ROM '     ',        '8000'
        ROM '      ',       '7da3'
        ROM '      ',       '0093'
        ROM '',             '0000'
        ROM '',             '0000'
        ROM '',             '0000'
        ROM '',             '0000'
;*
;* 32K values
;*                                C          C#          D          D#
        ROM '',             '42f9','e49f','46f5','70df','4b2d','9d3e','4fa6','049c'
;*                                E          F           F#         G
        ROM '',             '5462', '78b9','5967','0579','5eb7','f459','6459','d01a'
;*                                G#         A           A#         B
        ROM '',             '6a51','689e','70a3','d70a','7756','821e','7e6f','22d3'
        ROM '      ',       '5556'
        ROM '     ',        'c000'
        ROM '      ',       '7b98'
        ROM '      ',       '00fc'
```

TABLE 5-continued

| | | |
|---|---|---|
| 67 | ROM '', | '0000' |
| 68 | ROM '', | '0000' |
| 69 | ROM '', | '0000' |
| 70 | ROM '', | '0000' |

ADVANTAGES OF THE INVENTION

It is, therefore, an advantage of the invention that a digital signal processor efficient in a memory space and processing cycles is used to generate and attenuate tones.

It is a further advantage of the invention that a tone is attenuated without creating additional sounds or artifacts at the end of the tone, such as "clicks", "pops", or "thuds".

It is a further advantage of the invention that a large number of tones and tone durations are produced across and beyond the entire audio range.

It is a further advantage of the invention a sine wave of highly accurate frequency is produced.

It is a further advantage of the invention that a segment of a playing audio stream is replaced with a tone of substantially the same sampling frequency as the audio stream in order to maintain synchronization between audio and video data.

ALTERNATIVE EMBODIMENTS

As previously described, the invention has been described with respect to three embodiments, including a pseudo-code representation (Table 1), a C code implementation (Table 2) and a DSP code implementation (Table 3).

By selection of a different ΔT, a different set of frequencies by the power of 2 may be used to generate a new Table 5 of tone constants. Also, by building a different Table 5 of tone constants, a different scale may be derived, such as one tuned to International Pitch with A4 equal to 435 cycles per second, or the Scientific or Just scale where C4 is equal to 256 cycles per second.

It will be appreciated that, although specific embodiments of the invention have been described herein for purposes of illustration, various modifications may be made without departing from the spirit and scope of the invention. In particular, it is within the scope of the invention to provide a memory device, such as a transmission medium, magnetic or optical tape or disc, or the like, for storing signals for controlling the operation of a computer according to the method of the invention and/or to structure its components in accordance with the system of the invention.

I claim:

1. Method for operating a digital signal processor to generate and attenuate an audible tone over a wide frequency range, comprising the steps of:

during a pure tone period, generating as an output value a digital representation of the sine of a requested tone frequency and amplitude;

during an attenuate period, generating said output value a digital representation of a disturbed but continuous sine of decreasing amplitude; and during a decay period, generating said output value as a digital representation of a substantially continuous function which decays to zero.

2. The method of claim 1, further comprising the step, executed during said attenuation period, of multiplying the amplitude at zero crossings by a fractional constant.

3. The method of claim 2, further comprising the steps, executed during said attenuate period, of incrementing the amplitude between subsequent samples within a zero passing zone by incremental values and accumulating a bank of accumulated increments.

4. The method of claim 3, further comprising the steps, executed during said attenuate period, of generating while approaching zero a sine wave of maximum amplitude equal to the amplitude at the last zero crossing minus said bank of accumulated increments.

5. The method of claim 1, further comprising the steps of:

responsive to a tone request including a sampling index, a tone index and a duration index, calculating an angle increment value;

responsive to a sample interrupt, incrementing an angle by said angle increment value, computing the sine value of the incremented angle, and adjusting the sine value for attenuation to produce said digital representation.

6. The method of claim 5, further comprising the steps of responsive to said sampling index and said duration index, calculating a sample count value; and responsive to each said sample interrupt, stepping said sample count value to count out said pure tone period and initiate said attenuate period.

7. The method of claim 6, further comprising the step, responsive to said sample count value stepping through said pure tone period, of initiating said attenuate period.

8. The method of claim 7, further comprising the steps:

responsive to a sampling interrupt during said pure tone period, generating said output value according to the relationship:

$$y(i)=m*\sin(\alpha(i));$$

responsive to a sampling interrupt during said attenuate period resulting in incrementing said angle past zero, generating said output value according to the relationship:

$$y(i)=z*m*\sin(\alpha((i));$$

responsive to a sampling interrupt during said attenuate period resulting in an incremented angle within said zero passing zone, generating said output value according to the relationship:

$$y(i)=m*\sin(\alpha(i))-\beta(i);$$

responsive to a sampling interrupt resulting in accumulating said incremented angle into the first or third quadrant and beyond said zero passing zone, generating said output value according to the relationship:

$$y(i)=(m-\beta)*\sin(\alpha(i); \text{ and}$$

responsive to a sampling interrupt resulting in accumulating said incremented angle into the second or fourth quadrant, generating said output value according to the relationship:

$$y(i)=m*\sin(\alpha(i)).$$

9. A memory device for storing signals for controlling the operation of a digital signal processor to generate and attenuate an audible tone over a wide frequency range, according to the method of:

during a pure tone period, generating as an output value a digital representation of the sine of a requested tone frequency and amplitude;

during an attenuate period, generating said output value a digital representation of a disturbed but continuous sine of decreasing amplitude; and during a decay period, generating said output value as a digital representation of a substantially continuous function which decays to zero.

10. A digital signal processor for generating and attenuating an audible tone over a wide frequency range, such as throughout and beyond the human audible range, the tone selectively being of short duration, comprising:

tone request logic responsive to a request to generate a tone of a specified tone and sampling index for determining an increment angle;

sample generation logic responsive to said increment angle and a periodic sampling interrupt for:

generating during a tone period a digital representation of the sine of a requested tone frequency and amplitude;

generating during an attenuation period a digital representation of a disturbed but continuous sine of decreasing amplitude; and generating during a decay period a digital representation of a continuous function which decays to zero from said sine of decreasing amplitude.

11. The memory device of claim 9, said method further comprising multiplying the amplitude at zero crossings by a fractional constant during said attenuation period.

12. The memory device of claim 11, said method further comprising incrementing the amplitude between subsequent samples within a zero passing zone by incremental values and accumulating a bank of accumulated increments during said attenuate period.

13. The memory device of claim 12, said method further comprising generating while approaching zero during said attenuate period a sine wave of maximum amplitude equal to the amplitude at the last zero crossing minus said bank of accumulated increments.

14. The memory device of claim 9, said method further comprising:

responsive to a tone request including a sampling index, a tone index and a duration index, calculating an angle increment value;

responsive to a sample interrupt, incrementing an angle by said angle increment value, computing the sine value of the incremented angle, and adjusting the sine value for attenuation to produce said digital representation.

15. The memory device of claim 14, said method further comprising:

responsive to said sampling index and said duration index, calculating a sample count value; and responsive to each said sample interrupt, stepping said sample count value to count out said pure tone period and initiate said attenuate period.

16. The memory device of claim 15, said method further comprising, responsive to said sample count value stepping through said pure tone period, of initiating said attenuate period.

17. The memory device of claim 16, said method further comprising:

responsive to a sampling interrupt during said pure tone period, generating said output value according to the relationship:

$$y(i)=m*\sin(\alpha(i));$$

responsive to a sampling interrupt during said attenuate period resulting in incrementing said angle past zero, generating said output value according to the relationship:

$$y(i)=z*m*\sin(\alpha(i));$$

responsive to a sampling interrupt during said attenuate period resulting in an incremented angle within said zero passing zone, generating said output value according to the relationship:

$$y(i)=m*\sin(\alpha(i))-\beta(i);$$

responsive to a sampling interrupt resulting in accumulating said incremented angle into the first or third quadrant and beyond said zero passing zone, generating said output value according to the relationship:

$$y(i)=(m-\beta)*\sin(\alpha(i); \text{ and}$$

responsive to a sampling interrupt resulting in accumulating said incremented angle into the second or fourth quadrant, generating said output value according to the relationship:

$$y(i)=m*\sin(\alpha(i)).$$

* * * * *